US005988535A

United States Patent [19]

Kime

[11] Patent Number: 5,988,535

[45] Date of Patent: Nov. 23, 1999

[54] METHOD AND APPARATUS FOR DEPOSITING SNOW-ICE TREATMENT MATERIAL ON PAVEMENT

[75] Inventor: James A. Kime, Columbus, Ohio

[73] Assignee: H.Y.O., Inc., Columbus, Ohio

[21] Appl. No.: 09/018,294

[22] Filed: Feb. 4, 1998

[51] Int. Cl.[6] ..... A01C 17/00

[52] U.S. Cl. ..... 239/687; 239/681; 239/682; 239/684; 239/650; 239/172; 239/176

[58] Field of Search ..... 239/677, 684, 239/687, 650, 661, 670, 672, 681, 146, 172, 675, 656, 665, 682, 176

[56] References Cited

U.S. PATENT DOCUMENTS

| | | | |
|---|---|---|---|
| 3,559,893 | 2/1971 | Gruben | 239/664 |
| 3,693,890 | 9/1972 | Torrey | 239/668 |
| 4,106,703 | 8/1978 | Magda | 239/656 |
| 5,318,226 | 6/1994 | Kime et al. | 239/1 |

*Primary Examiner*—Kevin P. Shaver
*Assistant Examiner*—David Deal
*Attorney, Agent, or Firm*—Mueller and Smith, L.P.A.

[57] ABSTRACT

Apparatus and method for depositing salt granular materials upon a highway pavement at practical speeds. The deposition forms two narrow bands of the salt through utilization of two impeller-based mechanisms which are canted downwardly at an acute angle toward the pavement. The dump bed of trucks utilizing the apparatus is maintained in a down orientation through the utilization of a salt transport mechanism implemented as dual augers extending the length of the truck bed. Two embodiments of the apparatus are described each being self-contained and mountable upon a truck bed with relative ease. In one embodiment, a brine formation tank of generally triangular cross-sectional configuration is combined with a brine holding tank to form the sides of a V-box hopper structure. The brine formation tank is charged with salt and water to form a saturated brine which is permitted to migrate through a baffling system to the brine holding tank. A liquid pump system then drives the liquid to a cross auger apparatus wherein auger components are used as the mixing mechanism for adding brine to granular salt prior to its ejection to form the continuous narrow bands which are effective to attack the ice/pavement bond typically encountered on winter highways. The second embodiment utilizes the full capacity of the dump bed in conjunction with hydraulically biased contractor assemblies to move salt into a bed auger assembly.

26 Claims, 15 Drawing Sheets

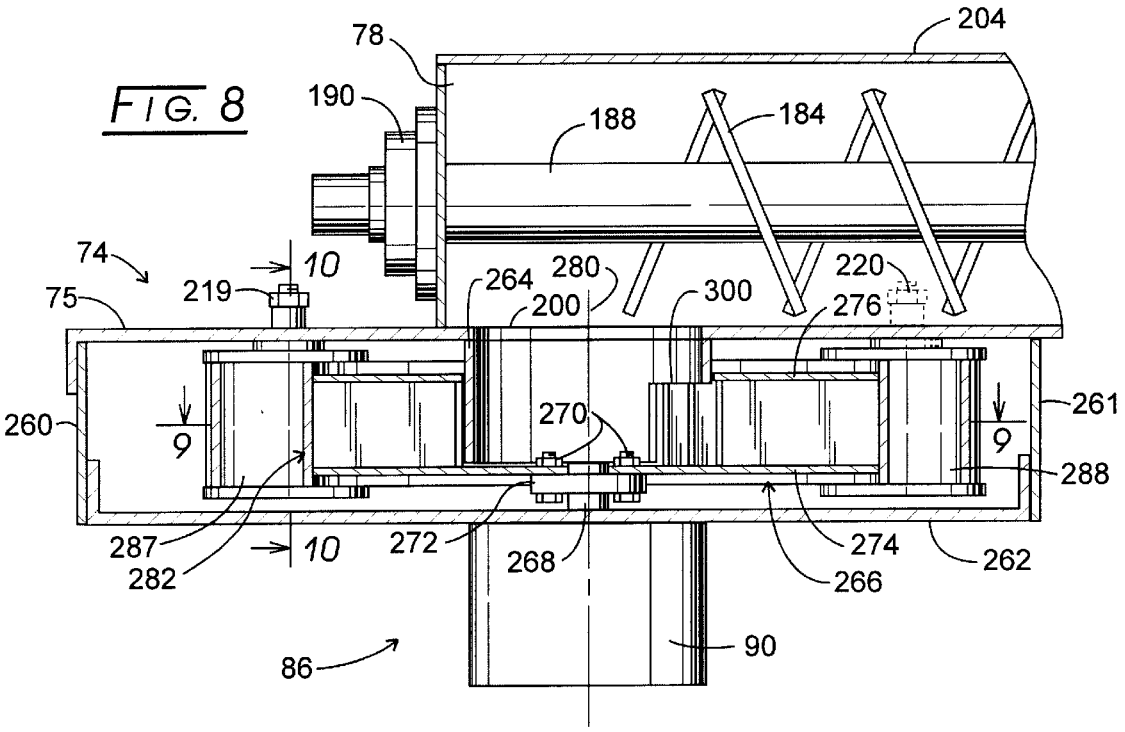
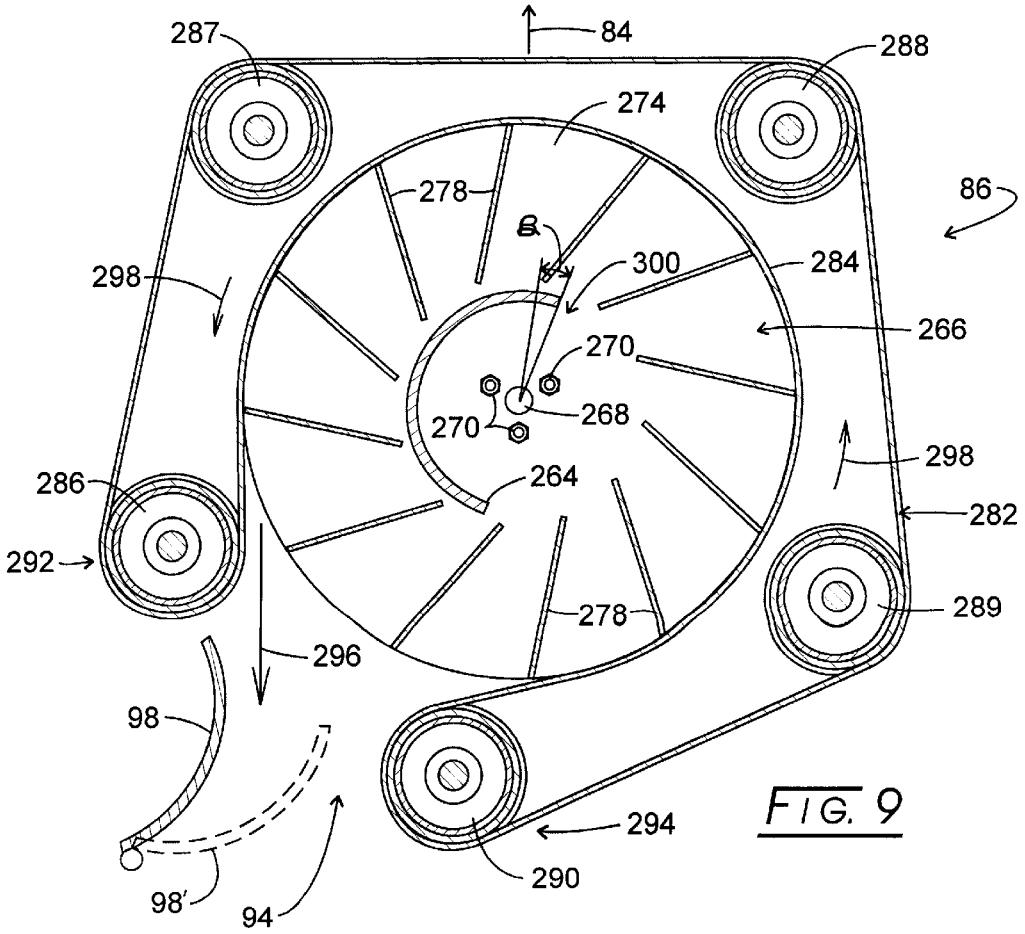
FIG. 9

POWER UP
770
772
INITIALIZATION
774
776
ENTER MAIN LOOP
778
818
780
MODULE SELECT
782
784
786
CONFIGURATION
788
DATA LOG
790
COMMUNICATIONS
792
PRESSURE READINGS
794
FLUID TEMP
796
FAULT HANDLING
798
PLOW HANDLING
800
BED CONTROL
802
SPEED
806
SPINNER
808
WETTER
810
AUGER
SPREADER
804
812
USER INTERFACE (DISPLAY) (CALIBRATION)
814
RETURN
816
818

METHOD AND APPARATUS FOR DEPOSITING SNOW-ICE TREATMENT MATERIAL ON PAVEMENT

BACKGROUND OF THE INVENTION

Highway snow and ice control typically is carried out by governmental authorities with the use of dump trucks which are seasonally modified by the addition of snow-ice treatment components. These components will include the forwardly-mounted plows and rearwardly-mounted mechanisms for broadcasting materials such as salt or salt-aggregate mixtures. The classic configuration for the latter broadcasting mechanisms included a feed auger extending along the back edge of the dump bed of the truck. This hydraulically driven auger effects a metered movement of material from the bed of the truck onto a rotating spreader disk or "spinner" which functions to broadcast the salt across the pavement being treated. To maneuver the salt-based material into the auger, the dump bed of the truck is progressively elevated as the truck moves along the highway to be treated. Thus, when into a given run, the dump bed will be elevated, dangerously raising the center of gravity of the truck under inclement driving conditions.

An initial improvement in the controlled deposition of salt materials and the like has been achieved through the utilization of microprocessor driven controls over the hydraulics employed with the seasonally modified dump trucks. See Kime, et al. in U.S. Pat. No. Re33,835, entitled "Hydraulic System for Use with Snow-Ice Removal Vehicles", reissued Mar. 3, 1992. This Kime, et al. patent describes a microprocessor-driven hydraulic system for such trucks with a provision for digital hydraulic valving control which is responsive to the instantaneous speed of the truck. With the hydraulic system, improved controls over the extent of deposition of snow-ice materials is achieved. This patent is expressly incorporated herein by reference.

Investigations into techniques for controlling snow-ice pavement envelopment have recognized the importance of salt in breaking the bond between ice and the underlying pavement. Without a disruption of that bond, little improvement to highway traction will be achieved. For example, the plow merely will scrape off the snow and ice to the extent possible, only to leave a slippery coating which may be more dangerous to the motorist than the pre-plowed road condition.

When salt has been simply broadcast over the pavement from a typical spinner, it will have failed to melt sufficient ice to break the ice-road bond. The result usually is an ice coated pavement, in turn, coated with a highly dilute brine solution developed by too little salt, which will have melted an insufficient amount of ice for traction purposes. This condition is encountered often where granular salt material contains a substantial amount of "fines". Fines are very small salt particles typically generated in the course of transporting, stacking, and storing road maintenance salt in dome-shaped warehouses and the like.

Road snow-ice control studies have revealed that the activity of ice melting serving to break the noted ice-pavement bond is one of creating a saltwater brine of adequate concentration. In general, an adequate salt concentration using conventional dispersion methods requires the distribution of unacceptable quantities of salt on the pavement. Some investigators have employed a saturated brine as the normal treatment modality by simply pouring it on the highway surface from a lateral nozzle-containing spray bar mounted behind a truck. A result has been that the thus-deposited brine concentration essentially immediately dilutes to ineffectiveness at the ice surface, with a resultant dangerous liquid-coated ice highway condition.

Attempting to remove ice from pavement by dissolving the entire amount present over the entire expanse of pavement to be treated is considered not to be acceptable from an economical standpoint. For example, a one mile, 12 foot wide highway lane with a ¼ inch thickness of ice over it should require approximately four tons of salt material to make a 10% brine solution and create bare pavement at 20° F. Technical considerations for developing a salt brine effective to achieve adequate ice control are described, for example, by D. W. Kaufman in "Sodium Chloride: The Production and Properties of Salt and Brine", Monograph Series 145 (Amer. Chem. Soc. 1960).

The spreading of a combination of liquid salt brine and granular salt has been considered advantageous. In this regard, the granular salt may function to maintain a desired concentration of brine for attacking the ice-pavement bond and salt fines are more controlled by dissolution in the mix. The problem of excessive salt requirements remains, however, as well as difficulties in mixing a highly corrosive brine with particulate salt. Typically, nozzle injection of the brine is the procedure employed. However, attempts have been made to achieve the mix by resorting to the simple expedient of adding concentrated brine over the salt load in a dump bed. This approach is effective to an extent. However, as the brine passes through the granular salt material, it dissolves the granular salt such that the salt will not remain in solution and will recrystallize, causing bridging phenomena and the like inhibiting its movement into a distribution auger. Of course, the corrosive effect of the liquid brine upon the relatively mild steel forming the truck dump bed is not appreciated by truck operators.

The problem of the technique of deposition of salt in a properly distributed manner upon the highway surface also has been the subject of investigation. Particularly where bare pavement initially is encountered, snow/ice materials utilized in conventional equipment will remain on the highway surface at the time of deposition only where the depositing vehicles are traveling at dangerously slow speeds, for example about 15 mph. Above those slow speeds, the material essentially is lost to the roadside. Observation of materials attempted to be deposited at higher speeds shows the granular material bouncing forwardly, upwardly, and being broadcast over the pavement sides such that deposition at higher speeds is ineffective as well as dangerous and potentially damaging to approaching vehicles. That latter damage sometimes is referred to as "collateral damage". However, the broadcasting trucks themselves constitute a serious hazard when traveling, for example at 15 mph, particularly on dry pavement, which simultaneously is accommodating vehicles traveling, for example at 65 mph. The danger so posed has been considered to preclude the highly desirable procedure of depositing the salt material on dry pavement just before the onslaught of snow/ice conditions. Of course, operating at such higher speeds with elevated dump truck beds also poses a hazardous situation.

Kime, et al., in U.S. Pat. No. 5,318,226 entitled "Deposition of Snow-Ice Treatment Material from a Vehicle with Controlled Scatter", issued Jun. 7, 1994, (incorporated herein by reference) describes an effective technique and mechanism for controlling the scatter of the so-called granules at higher speeds. With the method, the salt materials are propelled from the treatment vehicle at a velocity commensurate with that of the vehicle itself and in a direction opposite that of the vehicle. The result is an effective suspension of the projected materials over the surface under a condition of substantially zero velocity with respect to or relative to the surface of deposition. Depending upon vehicle speeds desired, material deposition may be provided in controlled widths ranging from narrow to wider bands to achieve a control over material placement. Another "zero-velocity" method for salt distribution employing a different apparatus approach has been introduced by Tyler Industries, Inc. of Benson, Minn. See "Roads & Bridges", December 1995, Scranton Gillette Communications, Inc., Des Plaines, Ill.

Thus, while the difficulties attendant with broadcasting granular salt at more acceptable highway speeds have been addressed with some success, the technical challenge of breaking the ice-pavement bond with a practical quantity of salt such that motor vehicles may achieve adequate traction has remained an elusive goal.

BRIEF SUMMARY OF THE INVENTION

The present invention is addressed to apparatus and method for depositing snow-ice treatment (salt) material upon highway pavement from a moving vehicle. The technique of deposition is one wherein the material is deposited in a continuous narrow band which effectively attacks an ice-pavement bond by evoking a brine formation within the deposited band which maintains an adequate salt concentration. In this regard, the fines within the mixed material will initially dissolve to form a brine, and the concentration of that brine will be maintained by virtue of the larger granules of salt that are associated with the fines. To achieve this necessary brine formation, it is concomitantly important to maintain the integrity of the deposited material within a band formation. This is achieved, inter alia, by ejecting the salt material rearwardly of a snow-ice control vehicle both at a velocity commensurate with the forward speed of the vehicle and at a downward direction toward the pavement. The extent of this downward direction is that of an acute angle of less than about 15° with respect to the instantaneous plane of the highway pavement. This downward direction causes the narrow band deposition to occur within a short distance from the rear of the vehicle such that it is not entrained in an excessive degree in turbulent wind. Additionally, the airborne dwell time of the ejected salt is reduced. As a consequence, both fine and coarse granules of salt are effectively deposited without substantial scatter.

To accommodate for modern highway structures, the deposition system of the invention employs two ejector mechanisms to produce two spaced-apart narrow bands of deposited salt in contrast to the broad scattering approaches of the past. Such an arrangement accommodates situations wherein, for example, the right side of the road is elevated for a leftward curve and the like. Because the apparatus of the invention is capable of creating the narrow bands of deposited salt at relatively high utility vehicle speeds, it employs a salt material transport system preferably implemented by elongate augers which extend centrally along the bed of a dump truck. As a consequence, the bed remains in its lowered position during the deposition procedure, thereby contributing significantly to the safety of this initially hazardous road maintenance operation.

In one embodiment of the invention, a self-contained V-box hopper structure is provided within which the feeder panels of that structure form one component of a unique brine formation system. In this regard, one side of the hopper is formed as a brine formation tank having an upwardly disposed opening which is enclosed by a pivoting lid. That lid forms a part of the feed structure leading to the centrally disposed transporting system. In forming the brine, a front end loader is used to dump salt within the tank as well as within the V-box hopper component of the structure. Water then is added to that tank, and a saturated brine is formed in a matter of minutes. A leveling conduit then permits the saturated brine to migrate to a brine holding tank positioned and forming a part of the opposite side of the V-box hopper. The brine then is pumped from the latter tank to be mixed with granular salt. To accommodate for two ejector mechanisms at the rearward region of the truck, a cross-auger is utilized which feeds from a central location to each of the ejectors. Uniquely, the brine is admixed with granular salt within these augers, which are driven at a relatively high speed to enhance the mixing procedure. Having its salt retaining components formed principally of stainless steel, this embodiment employing a self-contained V-box hopper is readily inserted upon a dump bed of a truck in a matter of minutes and does not require cleaning after every use to avoid the corrosive effects of snow-ice treatment chemicals.

The preferred assembly for a salt transporter within the bed of the truck involves the utilization of paired elongate augers which extend between forward and rearward panel assemblies. With such an arrangement, one auger, in effect, feeds one ejector mechanim while the other auger feeds an opposite ejector mechanism. The bearings supporting the augers advantageously may be isolated from the corrosive salts within the bed itself. In one embodiment, the entire load capability of the truck bed is employed for carrying salt. To maneuver this bed retained salt to the centrally disposed augers, compactor panels are hydraulically driven angularly inwardly from the sides of the bed of the vehicle to urge the salt into engagement with rotating augers. Improvements also are developed in connection with the ejectors themselves. In this regard, freely-rotating pulleys are employed for an endless belt sidewall construct. The bearings of these pulleys are fully enclosed within cavities within the exteriors. Additionally, seals are provided at the top of the pulleys as they are mounted for rotation upon stationary shafts. The shafts in turn, incorporate covers which, in turn, protect the seals of the pulley from destruction by the granular salt chemicals involved in the methodology. To accommodate the ejector mechanisms to carry out at wide broadcasting of salt material, for example, at intersections or the like, at low speeds, deflector components are mounted adjacent the outlets of the ejectors to intercept or confront the ejected salt materials and broadcast them transversely of the vehicle.

For a fuller understanding of the nature and objects of the invention, reference should be had to the following detailed description taken in connection with the accompanying drawings.

BRIEF DESCRIPTION OF THE DRAWINGS

FIG. 8 is a partial sectional view taken through the plane 8—8 shown in FIG. 6;

FIG. 9 is a sectional view of an ejector employed with the apparatus of the invention taken through the plane 9—9 in FIG. 8;

DETAILED DESCRIPTION OF THE INVENTION

In the discourse to follow, two embodiments of the invention are revealed. In an initial embodiment, an assembly is described which is adapted to be positioned upon a dump truck bed and which incorporates a V-box or hopper shaped type body formed preferably of stainless steel. This design functions to carry granular salt and to gravitationally induce the salt to move toward a transport mechanism including dual augers located in a lengthwise orientation along the apparatus. The augers deliver granular salt to a cross transport mechanism implemented as a cross-auger which, in turn, distributes salt granules to dual, spaced-apart accelerating ejector mechanisms which project the salt rearwardly at a velocity having a vector component corresponding with the instantaneous velocity of the truck. However, the expression of these granules from the ejection mechanisms is at an acute angle with respect to the plane defined by the highway pavement along which the truck is driven such that deposition occurs as a narrow band-shaped continuous pile of granular salt which is formed on the pavement within about 5 or 6 feet from the rear of the truck. The V-box type apparatus also incorporates a brine formation and delivery system wherein a saturated salt brine is formed in situ on the truck and uniquely is mixed with the granules by the cross auger in somewhat close adjacency with their output to the ejector mechanisms. Preferably, this more elaborate embodiment of the invention is fashioned of stainless steel such that the labor and material expenditures otherwise required for cleaning after each "run" of the truck may be avoided.

In the second embodiment, the lengthwise positioned salt delivery augers are retained, as well as a cross auger and dual acceleration or ejector mechanisms. However, this embodiment employs the dump truck bed as the retainer of granular salt material. To facilitate the movement of the salt into the longitudinally disposed augers, pivoted side panels are formed with the apparatus which are hydraulically biased inwardly toward the augers. With this arrangement, potentially the entire volumetric capacity of the dump bed is utilized to carry the salt load.

Figure 1:
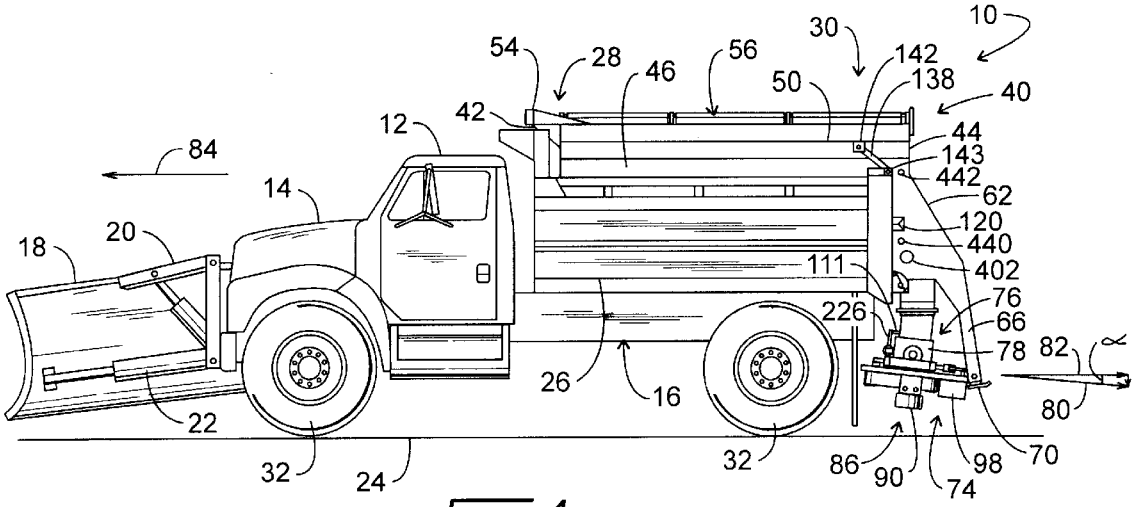
FIG. 1 is a side-elevational view of a truck outfitted with the apparatus carrying out the method of the invention.

Referring to FIG. 1, a utility vehicle employed for the seasonal duties of snow-ice removal is revealed generally at 10. Configured as a dump truck, vehicle 10 includes a cab 12 and hood 14 mounted upon a frame represented generally at 16. At the forward end of the vehicle 10, there is mounted a front snow plow 18 which is elevationally maneuvered by up-down hydraulic cylinder assembly 20. Additionally, front plow 18 is laterally, angularly adjusted by left- and right-side hydraulic cylinder assemblies, the left side one of which is represented at 22. Not shown in the figure is a wing plow which is mounted adjacent the right or left fender of the vehicle 10, and which functions generally as an extension of the front plow 18, serving to push snow off of a shoulder. Also not shown is an under body scraper plow which is a heavy duty plowing apparatus mounted beneath the vehicle 10 and which functions to utilize the weight of the vehicle 10 to peel or remove hard packed ice or snow at the pavement represented at 24. Vehicle or truck 10 supports a dump bed 26 having a forward region represented generally at 28 and a rearward region represented generally at 30. Bed 26 is selectively elevated about pivot connections at the rearward region 30. Truck 10 is supported on pavement 24 by wheels, certain of which are identified at 32.

Figure 2:
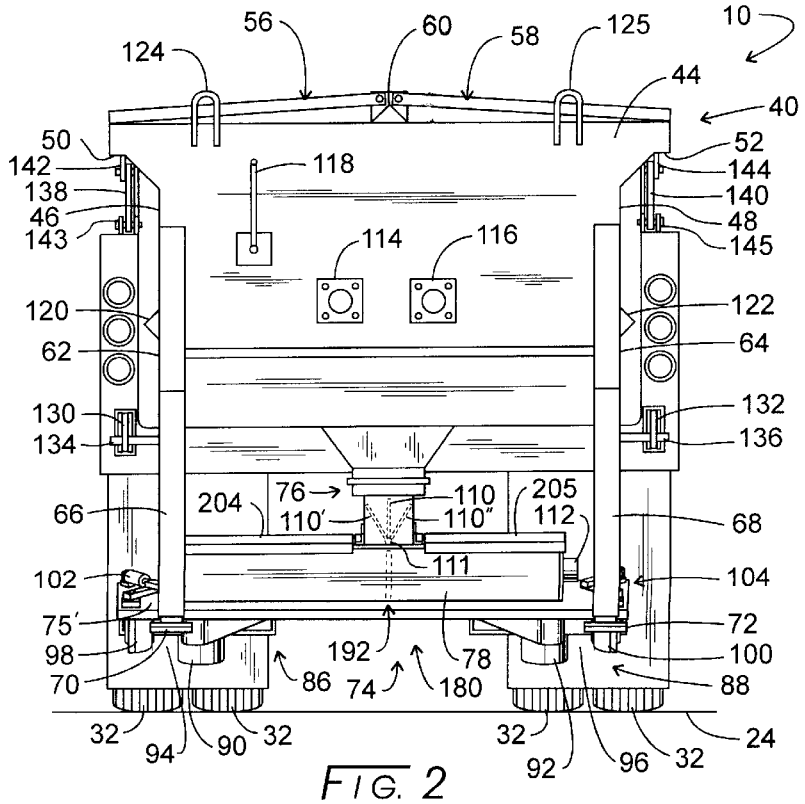
FIG. 2 is a rear-elevational view of the truck of FIG. 1.
Figure 3:
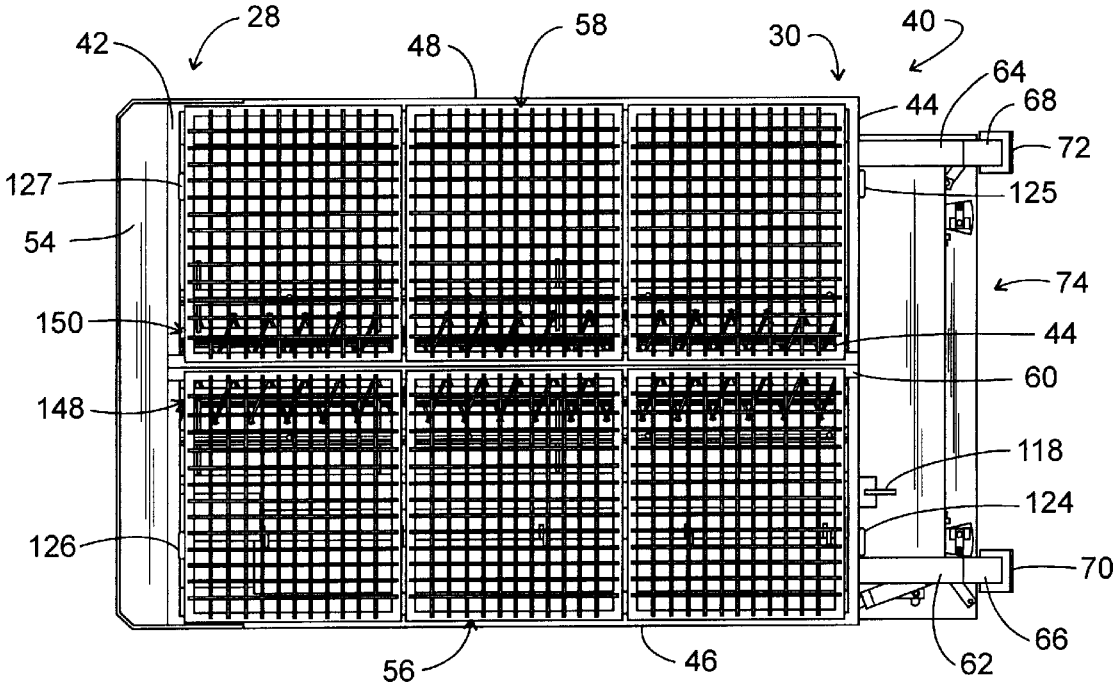
FIG. 3 is a top view of distribution apparatus mounted upon the truck of FIG. 1.

Carried by the truck 10 is an essentially self-contained chemical distribution apparatus represented at 40. Looking additionally to FIG. 2, the self-contained apparatus 40 generally is configured in box-like fashion, extending from a forward side or panel assembly 42 to a rearward side panel assembly 44 (FIGS. 2 and 3). The apparatus at 40 is formed having a somewhat outwardly slanted extension at each of its lateral sides 46 and 48 (FIG. 2) as shown, respectively, at 50 and 52. An auxiliary cab shield 54 is located above the forward panel assembly 42 and behind the shield 54 are three-component elongate grates shown generally at 56 and 58 which, as seen in FIGS. 2 and 3, are pivotally connected to an angle-shaped longitudinal beam 60 extending centrally along the lengthwise extent of the apparatus 40. Extending outwardly from the rearward side 44 of the apparatus 40 as well as outwardly from the bed 26 of truck 10, are two spaced-apart downwardly depending supporting structures 62 and 64, each having a downwardly depending and outwardly extending integrally formed leg component shown, respectively, at 66 and 68. Legs 66 and 68 are configured having a somewhat box-shaped configuration with attendant cavities such that they retain extensible foot structures shown, respectively, at 70 and 72. Supporting structures 62 and 64 along with their attendant leg components 66 and 68 serve, inter alia, to support the rearward side of a cross-structure represented generally at 74. Structure 74 additionally is supported by an inwardly-disposed salt delivery chute represented generally at 76 which is seen to be rigidly connected with an elongate box-like housing 78 which will be seen to retain the cross-transport mechanism or cross-auger of a transport mechanism employed with the apparatus 40. Service access into housing 78 is through hinged lids 204 and 205. Note that with this mounting, the cross-structure 74 is canted downwardly at an acute angle with respect to horizontal or, more particularly, with respect to the plane represented by the pavement surface 24. FIG. 1 illustrates this downward cant of the structure 74 in conjunction with a vector arrow 80 inclined downwardly from horizontal reference vector 82 by a small angle $\alpha$. Preferably, this acute angle $\alpha$ is less than about 15°, and typically is selected as about 7° to 10°. The forward movement and velocity or speed of the truck 10 is represented by the forward vector 84 which is seen to be parallel with the plane represented by pavement 24.

FIG. 2 reveals that two, spaced-apart material accelerating apparatuses, sometimes referred to as ejector-mechanisms as represented generally at 86 and 88, are mounted beneath the cross structure 74. Devices 86 and 88 are configured in somewhat similar fashion as a corresponding structure described in the above-noted U.S. Pat. No. 5,318,226. Each of the ejectors 86 and 88 contain a vaned impeller driven by a hydraulic motor. Hydraulic motors for devices 86 and 88 are shown, respectively, at 90 and 92. The outlets for devices 86 and 88 are, as described in connection with vector 80 in FIG. 1 slightly downwardly directed at an acute angle, and are represented, respectively, at 94 and 96. Note that, in the sense of the forward direction of truck 10, outlet 96 is shifted to the left with respect to wheels 32 a small distance, for example, about six inches as compared to the position of outlet 94.

Mounted in adjacency with the outlets 94 and 96 are deflector baffles or plates shown, respectively, at 98 and 100. These baffles are actuated into a position transversely diverting granular salt material expressed from outlets 94 and 96 to provide a broad spreading of the salt as opposed to the normally developed narrow band of salt. Such actuation is by hydraulic assemblies shown, respectively, at 102 and 104. Baffles 98 and 100 are actuated by the truck operator in the special circumstances where the truck 10 is depositing salt at lower speed, for example at an intersection or the like where a broadcasting of the material might be called for. Distribution of salt from the salt delivery chute 76 to the impeller mechanisms 86 and 88 is controlled by a distribution vane or baffle shown in phantom at 110 in FIG. 2. Baffle 110 is mounted upon a shaft 111 and normally divides the downwardly falling granular salt for equal distribution to mechanisms 86 and 88. However, baffle 110 may be hydraulically driven to either the leftward position at 110' or rightward position 110" to divert the salt, respectively, only to mechanism 88 or mechanism 86. Distribution is by a dual-directional cross auger arrangement having oppositely oriented blades which are driven from a hydraulic motor 112. Also seen in FIG. 2 are bearing components 114 and 116 which are utilized in conjunction with a "cake breaker" mechanism. A handle 118 extends from the rearward side 44 of apparatus 40 which is hand-actuated to open a brine door described later herein. The figure additionally reveals side members of triangular cross-section as at 120 and 122 which are employed in maneuvering the apparatus 40 in and out of the dump bed 26. Such maneuvering also can be carried out through the use of four, U-shaped lugs, two of which are revealed at 124 and 125 in FIG. 2, and which additionally are seen at 124–127 in FIG. 3. Apparatus 40 is retained upon the dump bed 26 in primary fashion by conventional tailgate books 130 and 132 which engage respective pins 134 and 136 extending from respective support structures 62 and 64. Additional attachment to the bed 26 is provided by rigid links 138 and 140, the ends of which are pivotally coupled to dual flanged tabs. These tabs are shown at 142 and 143 in FIG. 2 in pinned coupling association with link 138 and at 144 and 145 in pinned coupling association with link 140.

Figure 4:
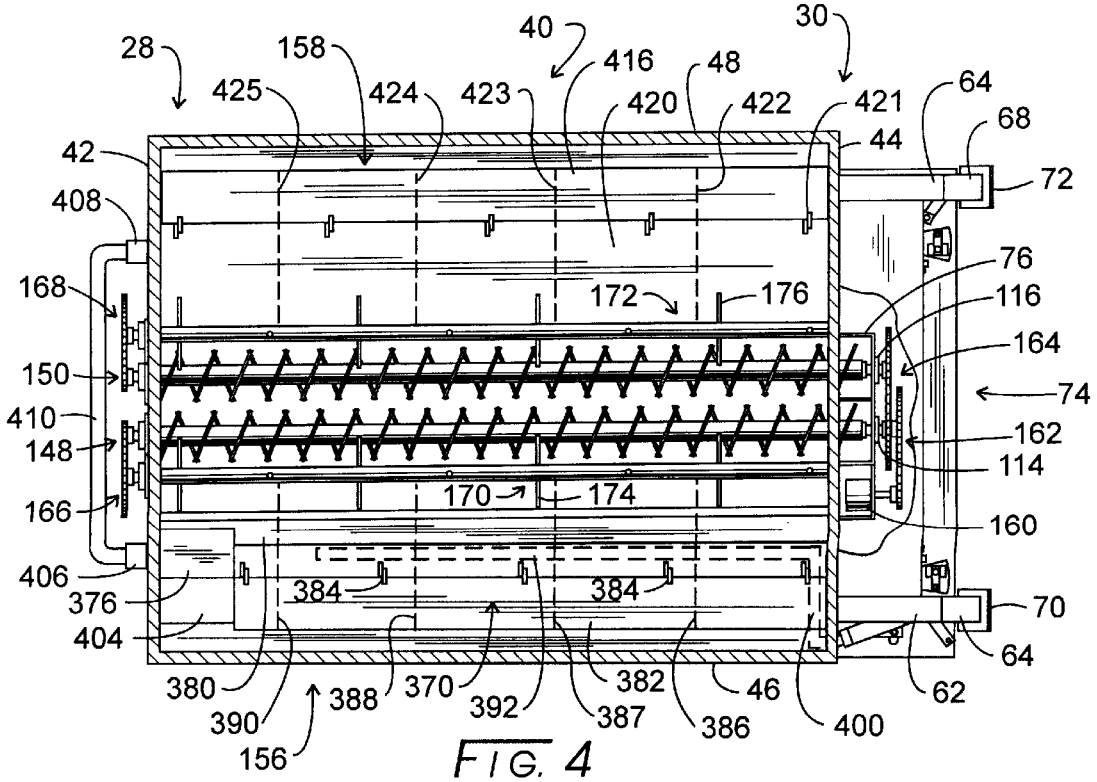
FIG. 4 is a top sectional view of apparatus employed with the truck of FIG. 1.
Figure 5:
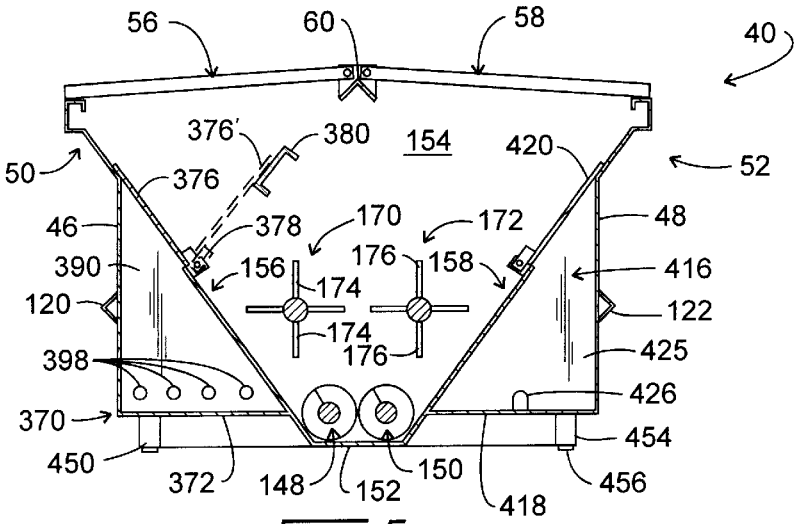
FIG. 5 is a sectional view taken through the plane 5—5 shown in FIG. 11.

The transport mechanism of the apparatus 40 includes a bed transport mechanism implemented by two elongate augers extending centrally from forward region 28 of bed 26 to rearward region 30. These two augers are discernible at 148 and 150 in FIG. 3. Looking to FIG. 4, augers 148 and 150 are revealed as extending from forward panel assembly 42 through rearward panel assembly 44 and into salt delivery chute 76. FIG. 5 reveals that the augers are positioned at the flat bottom panel 152 of a V-box hopper represented generally at 154 having sloping side components represented generally at 156 and 158. Components 156 and 158 extend upwardly and outwardly from bottom panel 150 to the respective extensions 50 and 52. FIG. 4 reveals that rotational drive is imparted to the augers from a hydraulic motor 160 through a gear and chain linkage represented generally at 162 which connects to auger 148. Auger 148, in turn, is coupled in driving relationship with auger 150 through a gear and chain assemblage represented generally at 164. The shafts of the augers 148 and 150 extend through forward side 42 at region 28 to respective gear and chain assemblies represented generally at 166 and 168. Assemblies 166 and 168, in turn, couple augers 148 and 150 in driving relationship with respective crust breaker assemblages 170 and 172. The positioning of crust or cake breaker assemblages 170 and 172 is revealed in FIG. 5. Note that each of the assemblages 170 and 172 is formed of a shaft from which breaker rods extend. Certain of the breaker rods associated with assemblage 170 are represented at 174, while corresponding breaker rods associated with assemblage 172 are shown at 176.

With the arrangement of an auger pair which can be positioned with the apparatus 40 at the bed 26 of the truck 10, the requirement for elevating the dump bed to move salt into the broadcasting component is eliminated. This has the dual advantage of maintaining a lower center of gravity for the truck 10, which then is more capable of depositing salt materials at relatively higher speeds and it permits the mounting of the ejector or material accelerating devices 86 and 88 in relatively close proximity to pavement 24. Thus, airborne travel time of the material following its ejection from outlets 94 and 96 is lowered.

Returning momentarily to FIG. 2, material moved to the rearward region of apparatus 40 is directed into the salt delivery chute 76 whereupon it falls under gravitational influence into the cross transport mechanism within housing 78. Where feed of this material is intended for both assemblies 86 and 88, then the distribution baffle 110 is in a vertical orientation wherein one-half of the granular salt material passing through the delivery chute 76 is distributed to each of the ejection devices 86 and 88. In the event one of the devices 86 or 88 is not utilized, then the vane will be moved to one of the earlier-described orientations 110' or 110".

Figure 6:
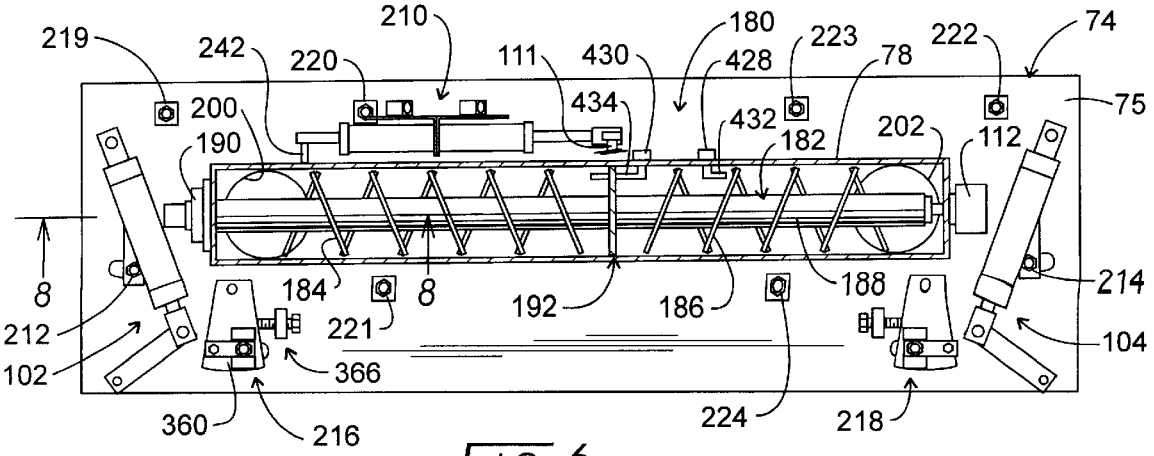
FIG. 6 is a top view of a cross structure and associated cross auger employed with the apparatus of FIG. 3.

Looking to FIG. 6, the illustration of the transport mechanism of apparatus 40 continues with a cross-transport mechanism represented generally at 180 which is implemented as a cross-auger 182 mounted within housing 78. Auger 182 is formed with two helical blade components 184 and 186 which are configured to move granular material in mutually opposite directions. The helical blade components 184 and 186 are mounted upon a common shaft 188 which extends from driven connection with hydaulic motor 112 to a bearing 190. A vertically oriented divider baffle represented generally at 192 separates the two helical blade components 184 and 186, and is arranged so as to be in vertical alignment with distribution vane 110 (FIG. 2). Looking momentarily to FIG. 6A, the divider baffle 192 is revealed as it is associated with shaft 188. In this regard, the baffle 192 is formed of two components, a lower portion 194 which is fixed by welding to the housing 78 below shaft 188, and an upper portion 196 which is removable. An aperture 198 is formed within lower portion 194 to provide passage of a brine carrying conduit. Returning to FIG. 6, it may be observed that the helical blade component 184 drives granular material to the annular inlet of ejector apparatus 86, while correspondingly, helical blade component 186 drives granular material to the annular inlet 202 of ejector mechanism 88.

Also mounted upon the upper plate 75 of cross support 74 are the earlier-described hydraulic assemblies 102 and 104 which function to actuate or move into diverting position the diverter baffles 98 and 100 (FIG. 2). A hydraulic drive assemblage also is mounted upon cross support 74 as shown at 210. This assemblage 210 functions to control the orientation of distribution baffle 110 as well as to provide control over the ball valves which will be seen to introduce brine to the cross auger 182. Also supported upon cross support 74 is a pulley adjustment mechanism 212 which functions to adjust the trajectory of the material ejected from ejector apparatus 86 by altering a loop location of a continuous belt associated therewith. A similar pulley adjustment mechanism is provided at 214 for carrying out the same adjustment function with respect to the ejection apparatus 88. Spaced from the adjustment mechanism 212 is a belt tension and tracking adjustment mechanism represented generally at 216. This mechanism adjusts the tracking and tension of the noted continuous belt for the ejection apparatus 86. A corresponding tension and tracking adjustment mechanim for utilization with the endless belt of ejector apparatus 88 is represented in general at 218. Pulley mounts for the ejector apparatus 86 additionally are shown connected with the sheet metal top of cross support 74 at 219–221. In similar fashion, additional pulley mounts employed in conjunction with the ejector apparatus 88 are shown at 222–224. These mounts include and secure the fixed shafts of the pulleys.

Figure 6A:
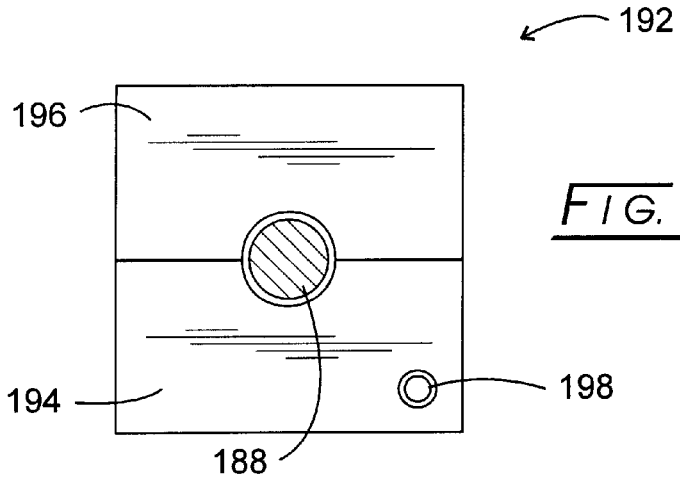
FIG. 6A is a plan view of a baffle employed with the cross auger shown in FIG. 6.
Figure 7:
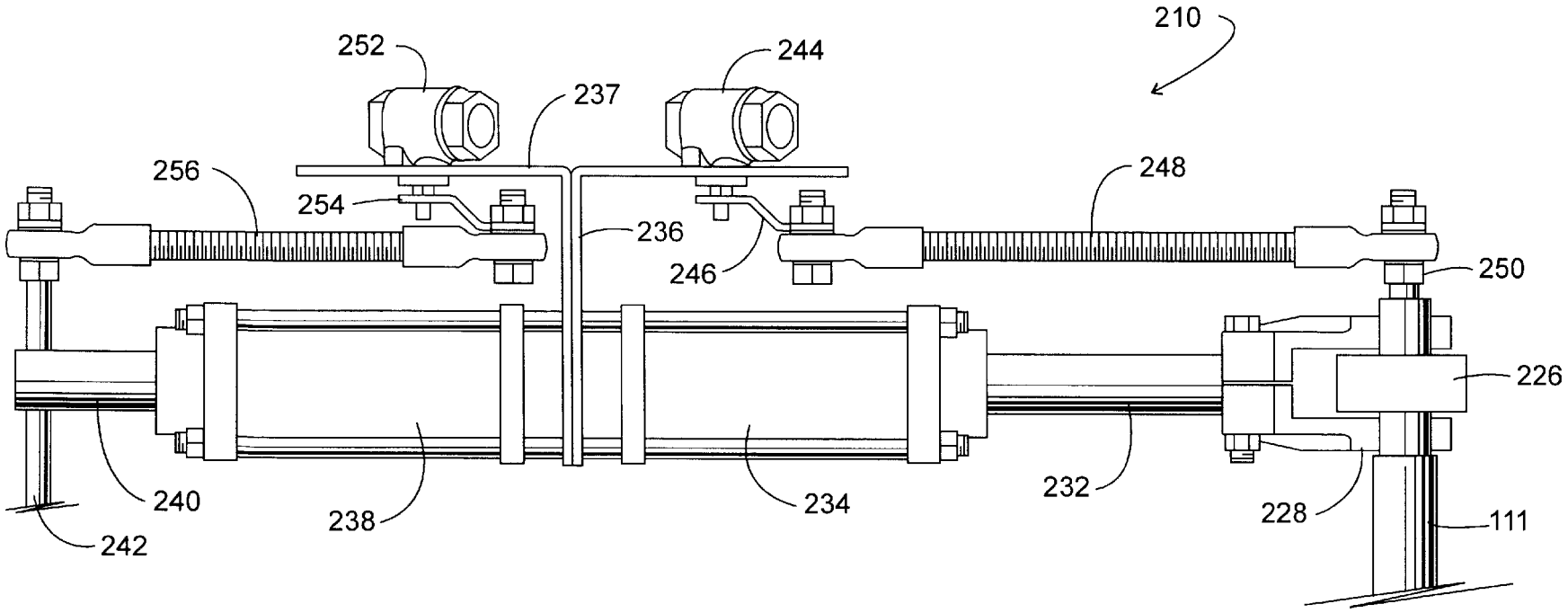
FIG. 7 is a top view of a hydraulic actuator mechanism employed with the cross auger apparatus of FIG. 6.

Referring to FIG. 7, the hydraulic drive assemblage 210 for altering the orientation of distribution baffle or vane 110 (FIG. 2) is illustrated. Vane 110 is connected to shaft 111 for the pivotal movement described earlier. Shaft 111 reappears in FIG. 7 having one necked down extension thereof 226 coupled to a crank arm 228. Thus, pivotal movement of crank arm 228 will impart a pivoting of the vane 110. Arm 228 is coupled by a pivotal clevis connection to the end of a piston 232 forming a component of a first hydraulic cylinder 234. Cylinder 234, in turn, is coupled to L-shaped plates 236 and 237. These plates additionally are coupled to a second hydraulic cylinder 238 having a piston rod 240 coupled to a rod 242 fixed to cross-support 74. This arrangement, utilizing first and second hydraulic cylinders 234 and 238, achieves a three position manipulation of the vane 110 coupled to shaft 111. For example, both piston rods 232 and 240 can be extended; both can be retracted; and one can be extended while the other is retracted to achieve a neutral position. One such neutral orientation for the hydraulic cylinder-based logic is represented in the figure. This arrangement of hydraulic cylinders also functions to control ball valves which introduce saturated brine into the cross transport housing 78 selectively on either side of divider baffle 192 (FIG. 6A). For this brine control, a ball valve 244 is mounted upon L-shaped plate 236. Valve 244 is actuated from a crank arm 246 which, in turn, is pivotally coupled by a rod 248 to a second necked down extension of shaft 111 at 250. A second such ball valve 252 is mounted to L-shaped plate 237 and is actuated by rotation of a crank arm 254 which, in turn, is pivotally coupled to a rod 256. Rod 256, in turn, is pivotally coupled to fixed shaft or rod 242. With the configuration shown, wherein piston rod 232 is extended and piston rod 240 is retracted, each of the valves 244 and 252 may be assumed to be open to deliver liquid brine. Additionally, the shaft 111 may be assumed to be positioned to locate vane 110 in a neutral or vertical orientation. However, should piston rod 232 be retracted, the shaft 111 will be rotated by arm 228 to divert granular material flow in one direction, and valve 244 will be closed while valve 252 is opened. Conversely, should piston rod 240 be extended while piston rod 232 remains extended, then crank arm 228 will rotate shaft 111 to position vane 110 at an opposite diverting orientation wherein ball valve 244 is open and ball valve 252 is closed. Finally, where piston rod 232 is retracted and piston rod 240 is extended, the crank arm 228 will position shaft 111 at a location providing for a neutral orientation of vein 110 and both valves 244 and 252 will be off.

Looking to FIG. 8, the material accelerating appartus or ejector reepresented generally at 86 in earlier figures is illustrated in more detail. Corresponding ejector 88 is of the same configuration but represents a mirror image of the mechanism 86. Mechanism 86 is coupled to the top plate or base 75 of the cross-structure 74 and further is protectively surrounded by a housing defining structure including side members 260 and 261, and bottom plate member 262. Extending downwardly from the periphery of the annular inlet 200 through which granular salt is introduced is a half cylindrical timing chute 264. Chute 264 introduces the granular salt material to an impeller represented generally at 266. Looking additionally to FIG. 9, the impeller 266 is seen to be mounted upon the shaft 268 of hydraulic motor 90. In this regard, three nut and bolt assemblies 270 extend from a collar 272 fixed to shaft 268 to securement with a lower dispose receiving surface 274 of the impeller 266. Receiving surface 274 has a circular periphery and is positioned beneath an upper surface 276 of similar configuration. FIG. 9 reveals a plurality of material engaging vanes, certain of which are identified at 278 which are fixed to the receiving surface 274 and extend upwardly therefrom. Note that the vanes are canted at an angle of about 45° with respect to a radius (not shown) extending from the axis of the impeller 266 as seen at 280 to its outer circular periphery. An upstanding endless belt represented generally at 282 and shown in FIG. 9 to have a surface positioned in abutting adjacency with the impeller circular outer periphery at 284 and extends about five freely rotating cylindrical pulleys 286–290. Note that pulleys 286 and 290 provide spaced apart loop portions identified, respectively, at 292 and 294 which function to define outlet 94 and function to produce the noted narrow band deposition along a vector 296 which is opposite the truck forward vector 84. The latter vector is reproduced in FIG. 9. In operation, granular salt moves through the inlet 200 (FIG. 8) and thence into the timing chute 264 to exit from a delivery opening 300 formed therein extending upward from the receiving surface 274 and by centrifugal force, the granular material is drawn to the outer circular perihery of the impeller 266. As the material reaches this outer periphery which is defined by the endless belt portion 284, it ultimately exits from the output 94 along vector 296 to produce the narrow band accumulation of material upon the highway. In the implementation shown, it has been found beneficial to alter the orientation of the delivery opening or window 300. In this regard, normally the extent of the opening 300 represents a half cylinder of timing chute 264. It has been found beneficial to, in effect, index or rotate this opening in a clockwise sense with respect to FIG. 9 by a small angle of about 15° from alignment with the vector 296. This affords the material being ejected more time to migrate to the outer circular periphery of the impeller 266 before being ejected from outlet 94. The angle is represented in FIG. 9 as angle β. Referring additionally to FIG. 6, pulleys 286–290 are coupled to the top plate 75 by the earlier-described connections represented, respectively, at 212, 219, 220, 221, and 216. FIG. 9 also reveals the location of the diverter baffle or deflector 98. Note that it has a curved profile and when actuated to the position shown at 98', will divert at least a portion of the granule material or ejectate expelled from the apparatus 86 laterally with respect to vector 296. This gives the operator of the truck an option to broadcast the ejectate material, for example, across an intersection or the like where the brine concentration otherwise required is not called for.

Figure 10:
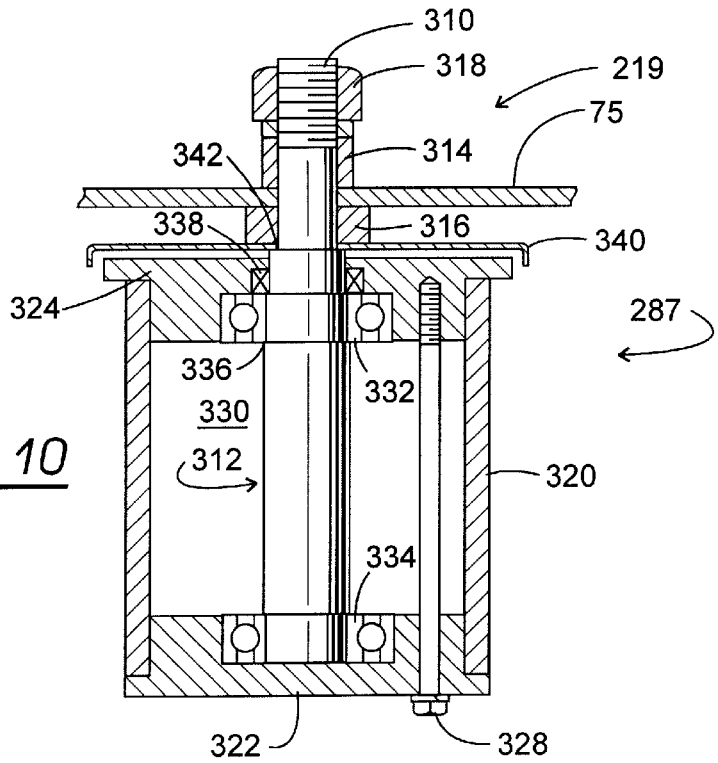
FIG. 10 is a sectional view of a plate taken through the plane 10—10 shown in FIG. 8.

As is apparent, the cylindrical pulleys 286–290 are called upon to perform in a highly abrasive and corrosive environment. This operational aspect of the devices has called for an improved pulley design. Looking to FIG. 10, an exemplary structure for the pulley, in particular, that at 287 is revealed. Looking to that figure, pulley 287 is seen to be suspended from top plate 75 by the earlier-described pulley mount 219. In this regard, mount 219 supports the threaded end 310 of a fixed shaft 312 through the utilization of collars 314 and 316 in combination with a nut 318. Collar 316 functions to space the pulley 287 downwardly from top plate 75. The outer components of pulley 287 are formed of a corrosion resistant stainless steel. In this regard, the pulley is formed having a cylindrical stainless steel side component 320 and oppositely disposed mild steel end components 322 and 324 which combine to define a cylinder. The entire arrangement is held together by three elongate stainless steel bolts, one of which is seen at 328. The bearings upon which pulley 287 rotates are seen to be retained within the chamber 330 defined by the structure and are seen at 332 and 334 in attachment with respective end components 324 and 322 and rotatively mounted upon the shaft 312. In this regard, the assembly is retained in position on the shaft 312 by virtue of the association of bearing 332 with an annular shoulder 336 formed within shaft 312. To prevent corrosive brine from migrating into the chamber 330 and associated bearings 332 and 334, a seal 338 is located above bearing 332 within component 324. However, to prevent a deterioration of this seal by granular salt components, an annular stainless steel shield is mounted between shoulder 342 within shaft 312 and collar 316.

Figure 6B:
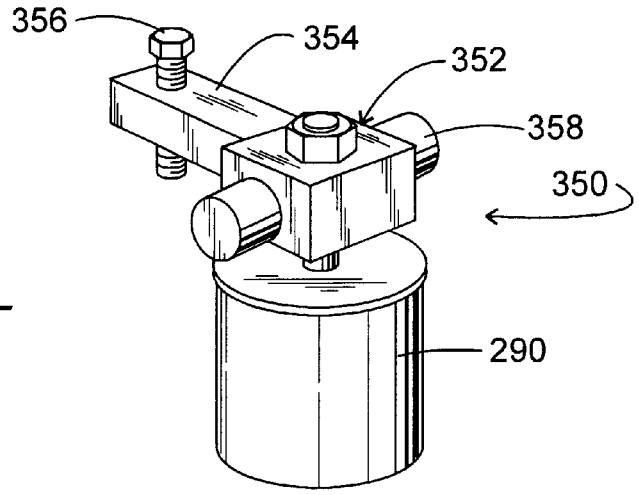
FIG. 6B is a perspective view of a belt tracking assembly shown in FIG. 6.
Figure 6C:
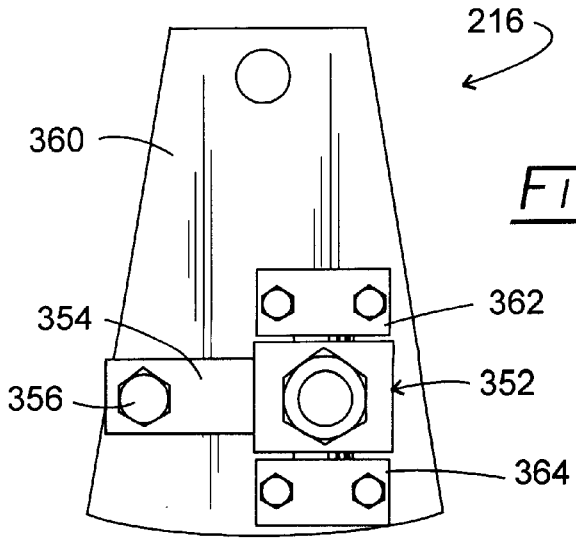
FIG. 6C is a top view of the apparatus of FIG. 6B.

As discussed generally in connection with FIG. 6, a tension and tracking adjustment mounting 216 is provided for one pulley of the ejector devices. In this regard, and looking momentarily to FIG. 9, that pulley which is utilized for this function has been described at 290. Looking to FIG. 6B, a portion of the mechanism for providing tracking adjustment of the pulley 290 is revealed. In this regard, the pulley 290 is mounted to a tracking fixture represented generally at 350 which permits its adjustment with respect to an axis perpendicular to the plane corresponding with top plate 75 of cross structure 74. In this regard, the shaft of pulley 290 is mounted to a somewhat T-shaped component 352 having an outwardly extending arm 354 at the tip of which there is threadably engaged an adjustment bolt 356. Extending through the fixture 352 is a shaft 358. With the arrangement shown, it may be observed that by adjusting the bolt 356, the arm 354 rotates the fixture 352 about the shaft 358 to alter the rotational axis orientation of pulley 290. Looking additionally to FIG. 6C, fixture 352 is mounted upon a triangularly shaped plate 360 carrying spaced apart pillow block mounts 362 and 364. As shown additionally in FIG. 6, the plate 360 is adjustable to provide belt tension by a bolt and tab assembly 366 fixed to the top plate 75 of cross structure 74. Paired bolt and tab assemblies as at 366 are employed in conjunction with the opening 94 and trajectory adjusting assembly 212. Assemblies 218 and 214 are configured in like manner as respective assemblies 216 and 212.

Figure 5A:
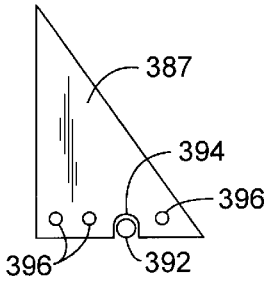
FIG. 5A is a plan view of a baffle employed with a brine formation tank included with the apparatus of FIG. 5.

The transport mechanism for maneuvering granular salt material within the system having thus been described, the discourse now turns to the in situ formation of brine and its admixture with the granular salt material at the auger components 184 and 186. Returning to FIGS. 4 and 5, side component 156 of the V-box or hopper 154 is seen to comprise a portion of an elongate brine formation tank represented generally at 370. Tank 370 is configured having a triangular cross-section with a bottom surface 372 (FIG. 5), side surface 46, the noted side component 156, and two sheet metal doors. The smaller of these sheet metal doors is seen in FIGS. 4 and 5 at 376 being coupled to a hinge assembly 378. FIG. 5 shows the smaller door 376 in a closed orientation and further illustrates the door at 376' in an open orientation wherein it rests upon an elongate channel member 380 extending between the forward side 42 and rearward side 44 of apparatus 40. Door 376 normally is closed. Extending rearwardly from the door 376 is a second, somewhat elongate door seen in FIG. 4 at 382 and having similar hinged assembly connections, certain of which are represented at 384. Tank 370 is supported and operationally enhanced by a plurality of transversely and vertically oriented baffles, three of which are shown at 386–388 in phantom in FIG. 4, and one of which is shown in phantom at 390 in adjacency with the smaller door 376. Supported upon the bottom surface 372 of tank 370 is an elongate polymeric perforated pipe shown in phantom at 392. Looking to FIG. 5A, exemplary baffle 387 is depicted having an opening 394 through which perforated pipe 392 extends. Additionally formed slightly elevated above the bottom edge of baffle 387 are three liquid ingress openings 396. Baffle 390 is revealed in FIG. 5 as having four such liquid ingress openings represented at 398. However, the perforated pipe 392 does not extend through this baffle 390. Pipe 392 is configured with an extension 400 seen in FIG. 4 which leads to an externally accessible fill coupling seen in FIG. 1 at 402.

Returning to FIG. 4, the smaller door 376, baffle 390, and the forward side 42 provide a clean or settling tank region represented at 404 intended to minimize migration of impurities and undissolved salt grains from the brine formation tank 370. Brine liquid from this region 404 passes through outlet 406 and inlet coupling 408 extending through side 42 which are coupled together by a polymeric balancing or cross-over conduit or pipe 410. Inlet 408 permits brine flow into a brine holding tank represented generally at 416 which is configured in similar fashion as brine formation tank 370.

In this regard, the tank is formed of side 48, V-box side 158, and bottom surface 418 (FIG. 5). A normally closed elongate door 420 is provided along the inside of the tank which is hinged at 421. Tank 416 is configured having four structurally supporting triangular shaped baffles shown in phantom in FIG. 4 at 422–425. Baffle 425 is seen additionally in FIG. 5. Note that baffle 425 incorporates a lower disposed liquid transfer opening 426. Baffles 422–424 are formed in identical fashion. Not shown in FIGS. 4 and 5 are flexible conduit connections extending to a hydraulically driven fluid pump supported by cross-structure 74, the output from which extends through ball valves 244 and 252 as described in conjunction with FIG. 7. The outputs from valve 244 and 252 extend to couplings located at the sides of cross auger housing 78. In this regard, the output of ball valve 244 may extend to a coupling 428 which, in turn, is coupled to a conduit or pipe 432 directing brine into the blade component 186 of the cross auger 182. Correspondingly, the output of ball valve 252 extends to coupling 430 and thence to conduit or pipe 434. Pipe 434 extends through the opening 198 in baffle 192 (FIG. 6A) and into the region occupied by helical blades 184 of the auger 182. Pipes 432 and 434 are unrestricted in that they do not carry out a nozzle function. Thus, the quantity of fluid brine delivered from them is easily controlled by the speed of the fluid pump associated with them. In general, auger motor 112 is slaved to the auger motor 160 functioning to drive bed augers 148 and 150. In this regard, the cross auger assembly is arranged to be rotated at a predetermined factor greater than the bed augers. For example, the cross auger 182 may be driven at a speed four times faster than the bed augers. This provides for mixing of brine with granular salt by the auger as opposed to mere deposition through nozzles or the like. In particular, nozzles impose an impediment to fluid quantity delivery. Thus, the combination of brine with granular salt may be optimized by the operator or automatically under microprocessor control.

In the utilization of the brining and granular salt distribution system, the operator hand actuates handle 118 as seen in FIG. 3 to cause the opening of the elongate door 382 of brine formation tank 370. The smaller door 376 remains closed. Using, for example, a front-end loader, then an amount of granular salt is dumped through the three component grates 56 to charge the brine formation tank 370 with granular salt. Generally, about a 12 inch depth of granular salt is added to the tank 370. Door 382 then is closed by handle 118 and the entire V-box or hopper 154 is filled with granular salt (FIG. 5). Truck 10 with mounted apparatus 44 then is moved to a source of water and water is added through fill coupling 402 (FIG. 1) to enter the brine formation tank 370 through the perforated pipe arrangement 392. Salt containing tank 370, thus charged along its length, forms a saturated brine in a matter of minutes, which brine migrates to smaller tank region 404, the baffles 386–388 and 390 functioning to cause impurities and excess salt particles not having gone into solution to remain within the region defined by baffles 386–388. In general, these particles and impurities do not migrate to the region 404 in substantial amounts. The saturated brine then passes through balancing pipe 410 to the brine holding tank 416 where, again, the liquid migrates through the opening in baffles 422–425 to provide an adequate quantity of saturated brine. Should both of the ball valves 244 and 252 (FIG. 7) be in an off state, it is prefferred that the output of the associated pump be recirculated into the brine formation tank 370. In addition to their role in brine formation and structural integrity, the baffles 386–388, 390, and 422–425 function to avoid liquid slosh phenomena which may occur with sudden stops of the truck 10. Water level in the tanks 370 and 416 may be evaluated utilizing a sight tube, preferably coupled with the brine formation tank 370. FIG. 1 shows a coupling 440 for providing liquid communication with the tank 370 as well as a second coupling 442 which functions to vent the sight tube which may be attached.

In general, it is preferred that the salt elected for forming the saturated brine is the same salt as is retained in its granular form within the hopper bed. The more economical selection which remains effective for snow-ice control is sodium chloride. Calcium chloride has been used to form brine solutions, however, it is highly corrosive and relatively expensive with respect to more common sodium chloride materials.

Figure 11:
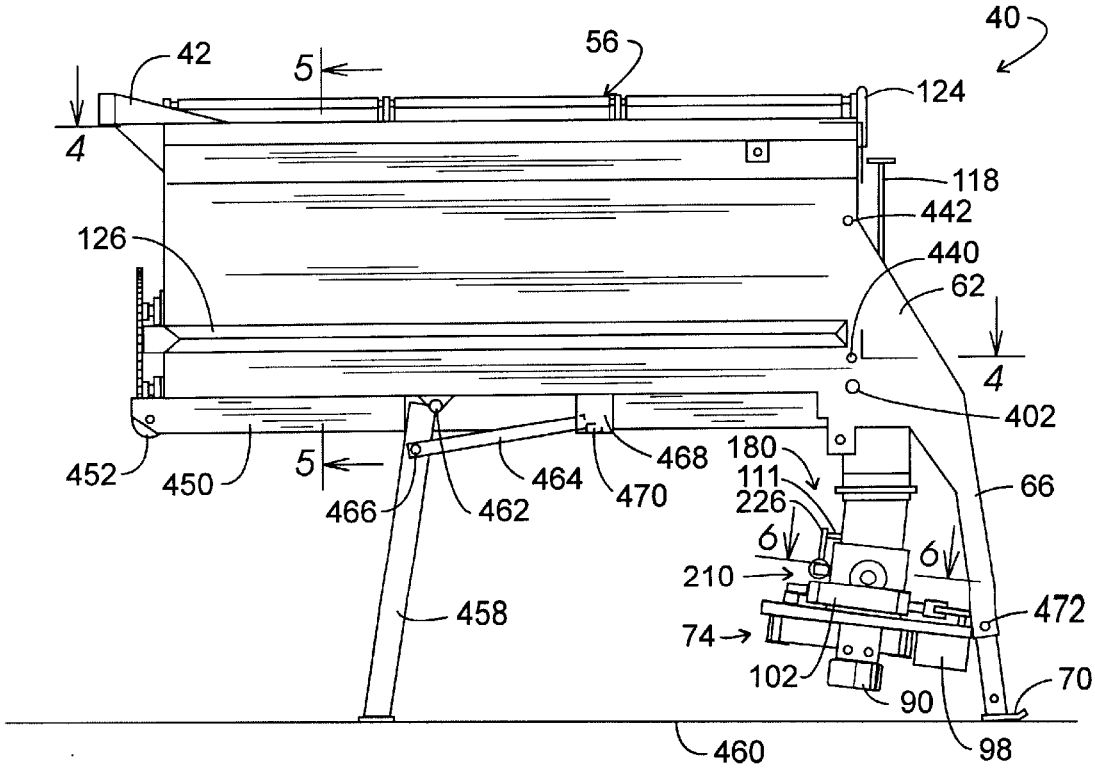
FIG. 11 is a side-elevational view of an embodiment of the apparatus of the invention.
Figure 12:
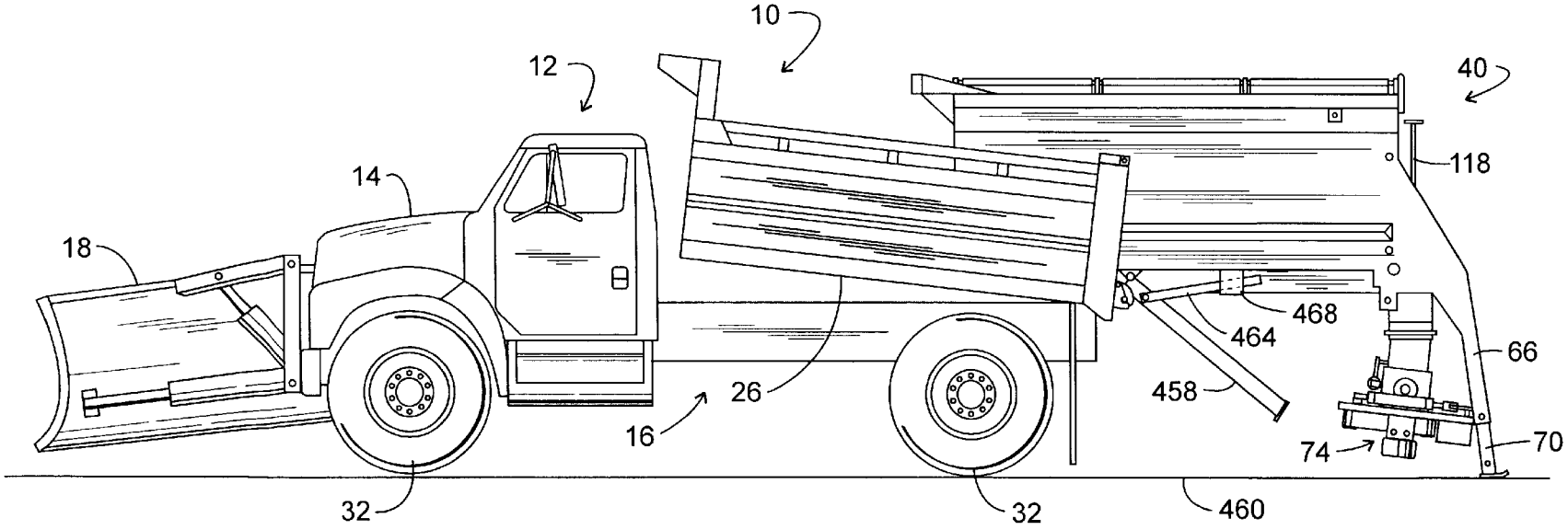
FIG. 12 is a side-elevational view showing the apparatus of FIG. 11 being loaded upon a truck bed.

The distribution apparatus 40 may be mounted upon the truck 10 utilizing a variety of approaches including the movement thereof by an overhead crane or the like utilizing the lugs 124–127 (FIG. 3). A convenient arrangement not requiring a crane or the like and taking advantage of its self-contained structuring is revealed in connection with FIGS. 11 and 12. FIGS. 5 and 11 show a box-like beam structure 450 attached to bottom portion 372 of tank 370. This structure 450 supports a slightly downwardly depending roller 452 intended for movement across the bottom of the bed 26 of truck 10. A similar structure is provided on the opposite side of the apparatus 40 as revealed in FIG. 5 as beam structure 454 and associated roller 456. Pivotally mounted behind each of the beam structures 450 and 454 are legs, one of which is seen in FIG. 11 at 458. Leg 458 is shown in FIG. 11 to extend to the pavement 460 and to be pivotally coupled to apparatus 40 at pivot point 462. A support rod 464 is pivotally coupled to the leg 458 at pivot 466 and extends to a box-shaped open latch 468 having a small protrusion therein shown in phantom at 470 which engages the end of rod 464 opposite its pivot at 466. FIG. 11 further reveals that the foot structure 70 has been extended to rest upon pavement 460 and is pinned at that extended orientation at 472. As is apparent, the foot structure 70 is preferably of a box cross-sectional configuration and is slidable within the leg component 66. A leg of similar structure as that at 458 is located upon the apparatus 40 immediately behind the beam structure 454. In this configuration, the apparatus 40 may be stored upon suitable pavement as at 460. When called upon for use in connection with a truck 10, the apparatus 40 may be sidably positioned upon the bed, the legs as at 458 being pivoted upwardly and the apparatus 40 sidably being inserted and then locked on the bed and then locked in place. FIG. 12 reveals such an arrangement wherein the apparatus 40 is either being removed from or slidably positioned upon bed 26. Looking to the figure, note that the bed 26 is slightly elevated and, for insertion of the apparatus upon that bed, truck 10 is moved in reverse and the legs as at 458 pivot rearwardly as the rollers 452 and 456 slide over the bottom of the bed. Support rod 464 will have been lifted to remove its engagement at latch 468 if the apparatus 40 is being removed from bed 26. Correspondingly, the support rod 464 will move forwardly as legs as at 458 descend in an unloading procedure. In the event of a loading activity, after the apparatus 40 is fully mounted in the bed 26, the bed is returned to its downward position and the feet such as at 70 are retracted into leg components 66 and 68, and pinned in that retracted orientation.

Figure 13:
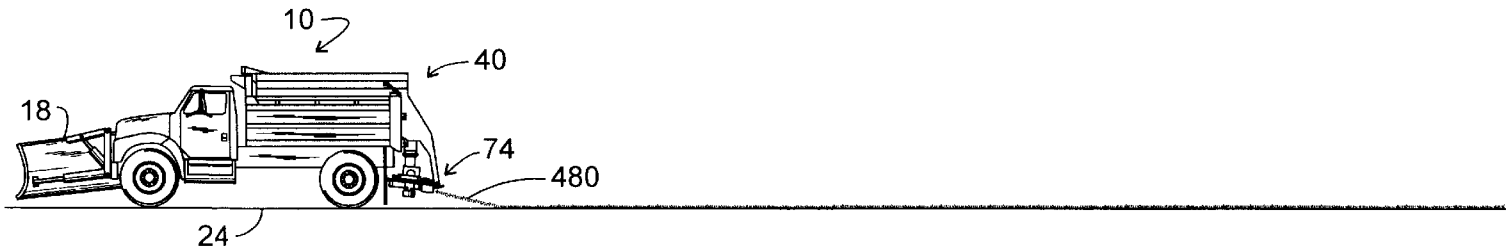
FIG. 13 is a side-elevational view of a truck outfitted according to the invention illustrating the material deposition method of the invention.

Referring to FIG. 13, the performance of the apparatus 40 in conjunction with truck 10 is revealed. In the figure, the result of the influence of the tilt of cross-structure 74 is revealed. With such tilting and the careful adjustment of the outlet of the ejector mechanisms 86 and 88, a narrow band of granular material with brine is ejected from each ejector mechanism as represented, for example at 480. The ejectant in band form creates a compact narrow continuous pile of the material a relatively short distance of 4 to 5 feet behind a truck structure 74. Thus, the material is laid down in this condensed fashion before encountering wind turbulence occasioned, for example, by the movement of truck 10.

Figure 14:
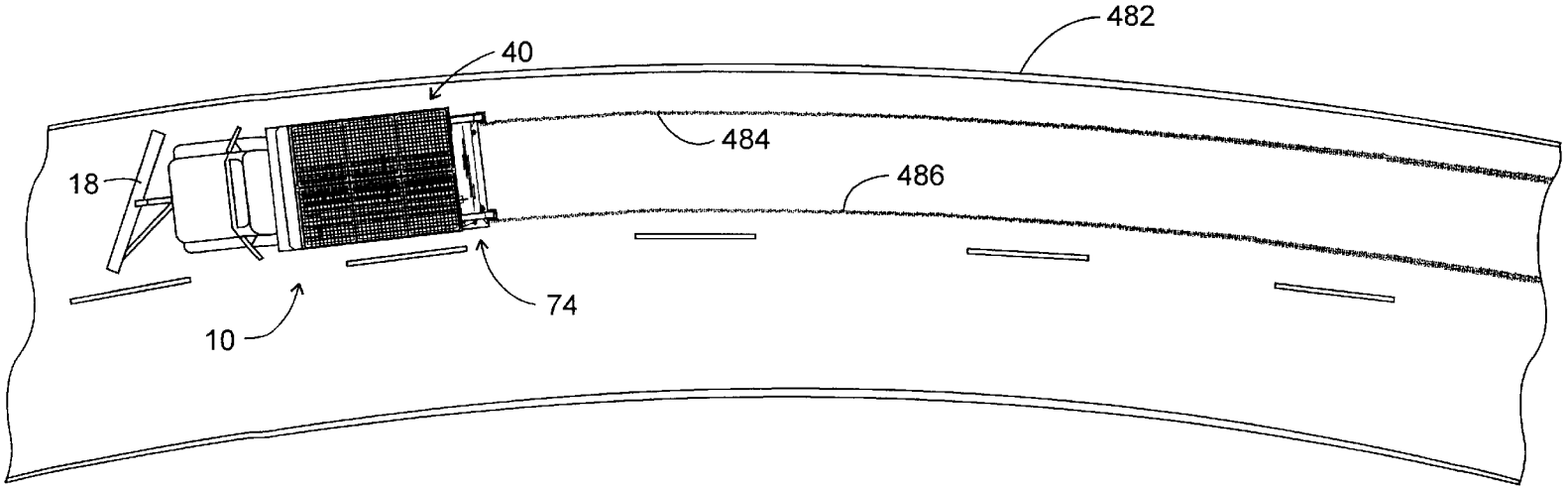
FIG. 14 is a top view of the vehicle and material deposition arrangement shown in FIG. 13.
Figure 15:
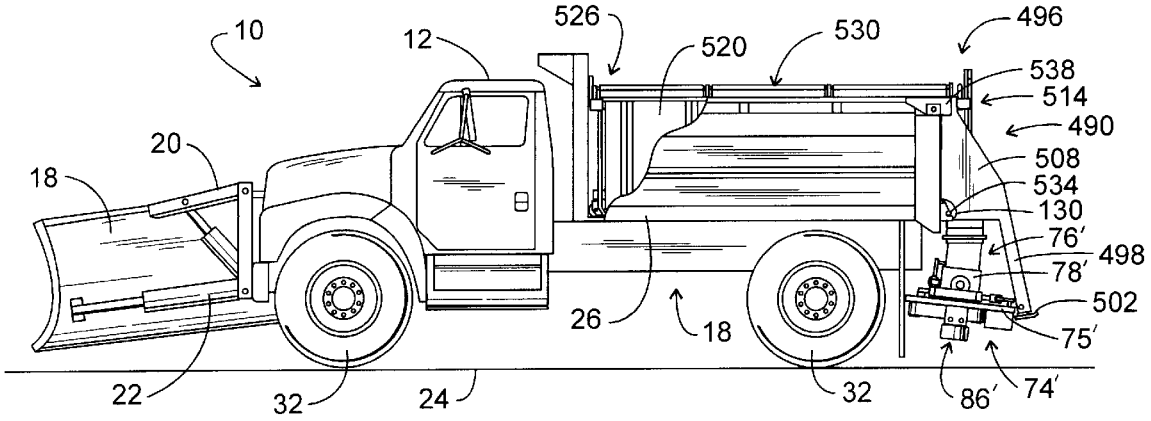
FIG. 15 is a side-elevational view of a truck outfitted with an alternative embodiment of the invention.
Figure 16:
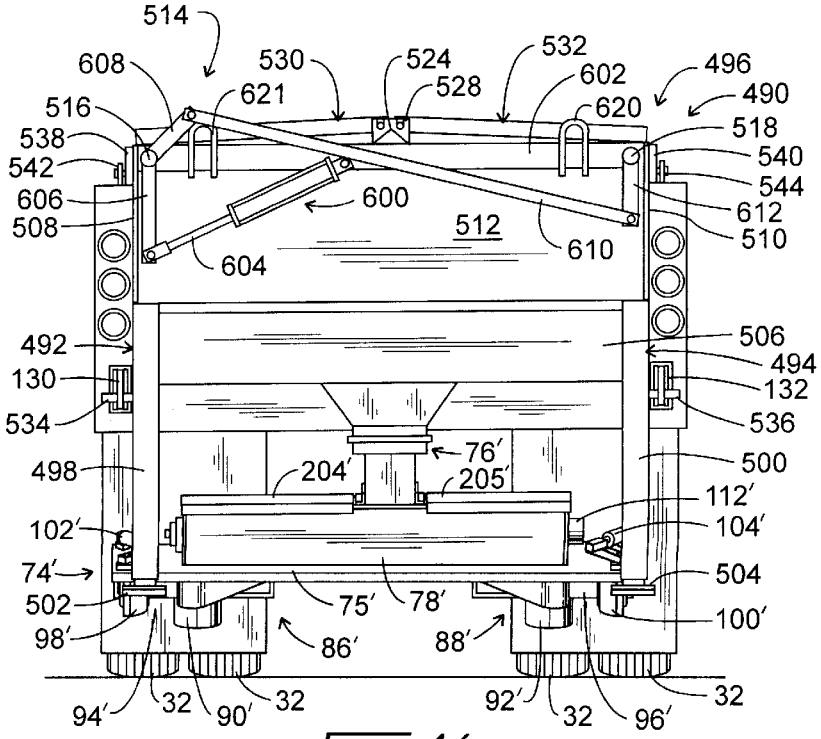
FIG. 16 is a rear view of the truck and associated apparatus show in FIG. 15.
Figure 20:
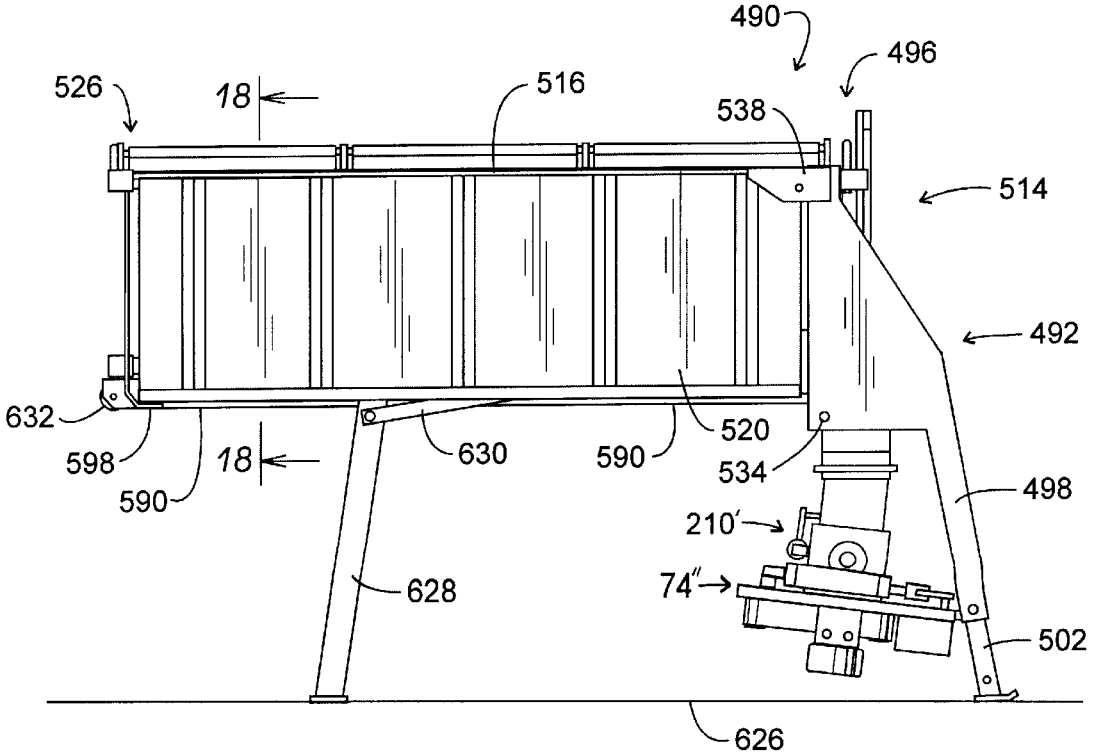
FIG. 20 is a side elevational view of the apparatus employed in connection with FIG. 15.

Looking additionally to FIG. 14, the importance and value of the utilization of two ejector mechanisms is demonstrated. In this figure, the truck 10 is distributing salt material in dual narrow bands 484 and 486 (less than about one foot in width) along a banked left turning curve of highway 482. Super elevation or banking of highway 482 will be, in a sense of right-to-left as considered in connection with the direction of movement of truck 10. Without the presence of band 484, the prior elevation of highway 482 will not be treated in the important method of the invention. The importance of the dual band 484–486 deposition also becomes apparent when one considers that many lanes of modern superhighways drain toward a central median. The self-contained chemical distribution apparatus 40 with its in situ brine formation and distribution is principally formed of stainless steel for purposes of permitting its use over more extended intervals of time without the requirement, for example, of cleaning following every use. This is a labor saving advantage which is coupled with a substantial savings in salt utilization over a typical winter period. Certain user entities, however, will wish to minimize their initial capital expenditure while taking advantage of the formation of dual narrow bands of granular salt, employing the thus-deposited narrow bands or mounds of granular salt to carry out the formation of saturated brine for breaking the ice-pavement bond. It is important additionally for such application to maintain a dump bed in a down or retracted position throughout the chemical material deposition process. The next embodiment of the invention provides such an arrangement wherein a self-contained unit is provided with a transport mechanism which includes a bed transporter formed as paired bed augers as well as a cross-transport mechanism as is employed in the initial embodiment along with dual ejector mechanisms. For this much less expensive embodiment, however, the bed of the truck itself is used for containing granular salt. In the discourse to follow, the components of the truck or utility vehicle are identified with the same numerical designation as given in earlier figures. Additionally, those components of the self-contained chemical distribution apparatus described earlier at 40 which remains substantially identical are given the same numerical designation in primed fashion. Thus, truck 10 reappears in FIG. 15 having a cab 12, hood 14, and a frame represented generally at 16. Snow plow 18 is attached to truck 10 along with hydraulic cylinder assemblies 20 and 22. The truck is sitting with wheels 32 on pavement 24 and is configured having a dump bed 26. Carried by the dump bed 26 is a chemical distribution apparatus represented generally at 490. As in the first embodiment, this distribution apparatus advantageously is self-contained in that it can be mounted as a unit upon the bed 26 of truck 10 in a matter of a few minutes. The lower rearward portion of the distribution apparatus 490 is similar to that of 40. In this regard, a stainless steel cross structure 74' having a stainless steel top member 75' supports two spaced-apart material accelerating or ejector devices 86' and 88'. As seen additionally in connection with FIG. 16, a stainless steel cross transfer housing 78' is mounted upon the top plate 75' having covers 204' and 205' which enclose a dual cross auger assembly in identical fashion as shown in FIG. 6. In particular, that portion of the assembly includes all of the components shown in FIG. 6 with the exception of the brine delivery associated components such as ball valves 244 and 252 as described in connection with FIG. 7. A stainless steel salt delivery chute 76' feeds the cross transport mechanism described in general at 180 in connection with FIG. 6. As before, this salt delivery chute 76' is fed granular salt material from the dump bed 26 by a bed transport mechanism. Spaced apart supporting structures represented generally at 492 and 494 are coupled to and extend from a rear panel assembly represented at 496. As before, these supporting structures 492 and 494 have extensions formed as respective box beams 498 and 500 which extend to support the cross structure 74' and incorporate extensible foot members shown, respectively, at 502 and 504. FIG. 16 reveals an elongate housing 506 supported between the structures 492 and 494, which houses a dual auger drive motor and the driven ends of two augers supplying granular material to the salt delivery chute 76'. Note in the figure that the support structures 492 and 494 extend in singular plate-like fashion to the upward region of the apparatus 490 as represented, respectively, at 508 and 510. This support arrangement provides an access region represented generally a 512 to provide for the mounting of a contractor drive mechanism represented, generally, at 514. Mechanism 514 functions to provide drive bias through elongate shafts 516 and 518 to contractor panels. One such panel 520 is seen rigidly coupled to shaft 516 in FIG. 15. An elongate beam 524 extends from the rear panel assembly 496 to a corresponding forward panel assembly 526. As seen in FIG. 16, the beam 524 is of angular cross-section and has coupled to the top thereof hinge plates as at 528 for the purpose of supporting three component grates extending to either side of the apparatus 490 as shown generally at 530 and 532. The grates are configured substantially identically to those described at 56 and 58 in connection with FIG. 3. Connection of the apparatus 490 with the dump bed 26 is by engagement of outwardly extending pins 534 and 536 (FIG. 16) with respective tailgate hooks 130 and 132. Additionally, engaging plates 538 and 540 extend between respective dual tab structures 542 and 544, and are engaged therewith by pins, the structures 542 and 544 being welded to the tops of the bed 26 sides at a rearward location. The configuration of the engaging plates is seen in FIG. 20.

FIG. 16 further reveals that the apparatus 490 includes two ejector or material accelerating devices as at 86' and 88', which are driven by respective hydraulic motors 90' and 92'. The outlets for these ejector mechanisms are shown, respectively, at 94' and 96', and they are associated with hydraulically actuated diverter deflectors or baffles 98' and 100'.

Figure 17:
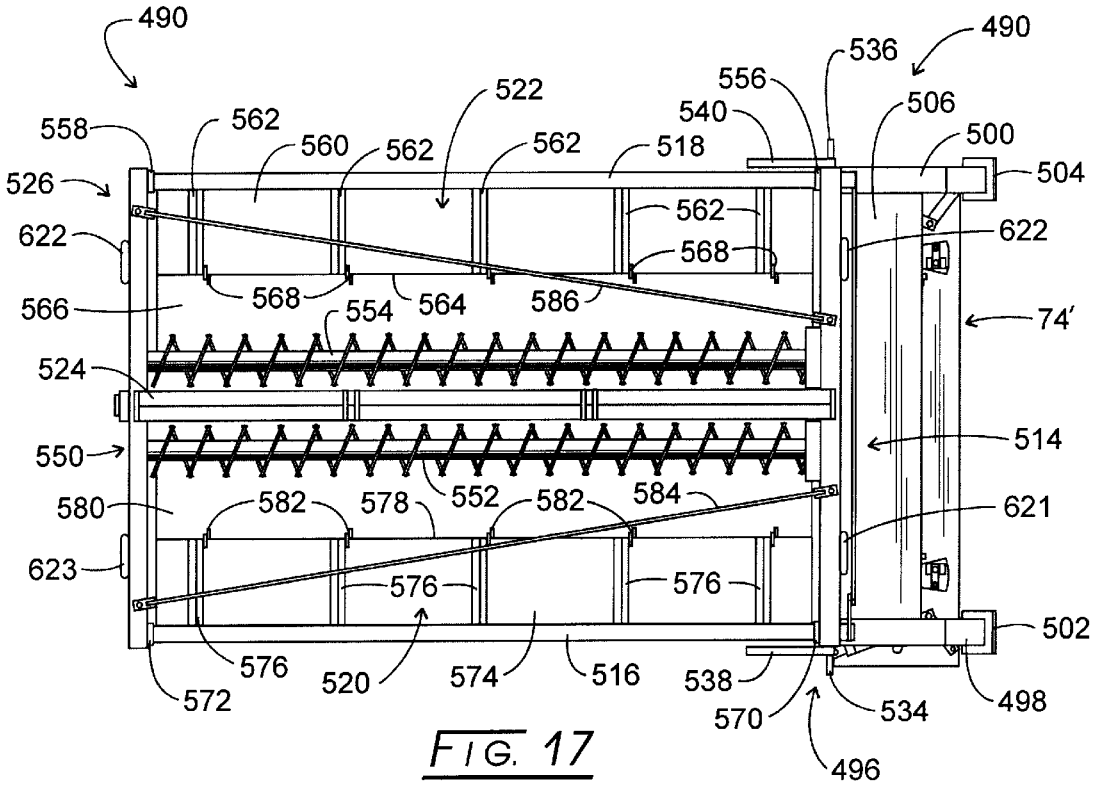
FIG. 17 is a top view of the apparatus employed with the truck of FIG. 15 with portions removed to reveal internal structure.

Turning to FIG. 17, a top view of the apparatus 490 is shown. In the view, a bed transport mechanism is represented generally at 550 as incorporating dual augers 552 and 554. Augers 552 and 554 are mounted for rotation between forward panel assembly 526 and a bearing and hydraulic drive motor retained within the housing 506. Augers 552 and 554 are thus mounted so as to be positioned slightly above the upper surface of the bottom of bed 26.

Elongate shaft 518 is seen mounted between bearings 556 and 558, and is coupled in driven relationship with the contractor drive mechanism 514. Rigidly connected to shaft 518 is contractor panel 522. Panel 522 includes an upper component 560 which is rigidly attached to shaft 518 and is seen to be formed having a sequence of stiffening crimps 562 of triangular cross-section. In FIG. 17, panel 522 is oriented angularly downwardly toward the auger 554. Pivotally attached to the lower edge 564 of upper component 560 is a bed bottom surface sliding component 566. Pivotal connection of component 566 with component 560 is by hinges, certain of which are identified at 568. In the extended orientation of the figure, the slide component 566 extends in sliding relationship about the top surface of the bottom of bed 26, and is located just beneath auger 554.

Figure 18:
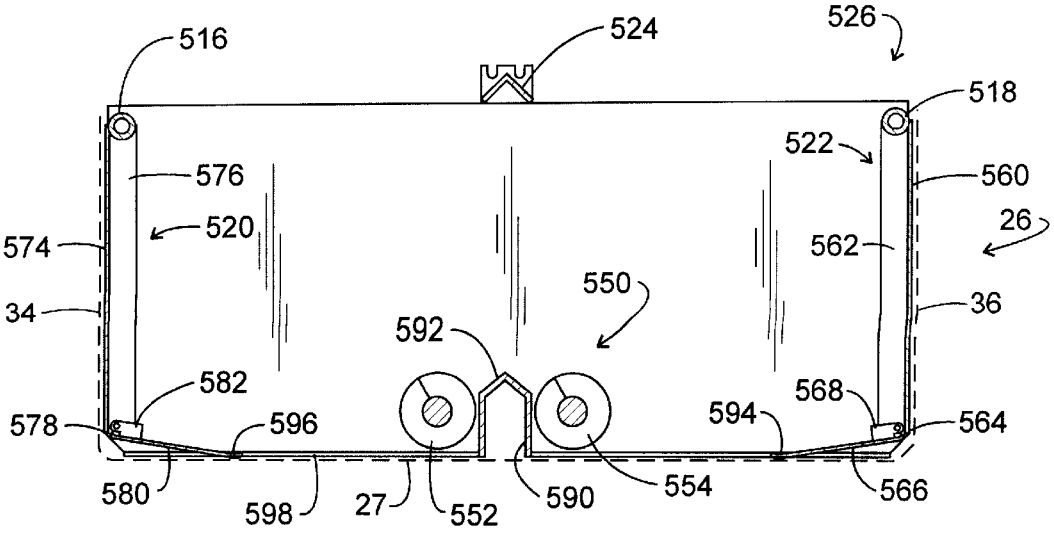
FIG. 18 is a sectional view taken through the plane 18—18 shown in FIG. 20.

Elongate shaft 516 is seen to be mounted between bearings 570 and 572, and is coupled in driven relationship with the contractor drive mechanism 514. Rigidly attached to shaft 516 is the upper component 574 of contractor panel 520. As before, the component 574 is formed having a sequence of stiffening crimps 576 of triangular cross-section, and is seen to extend to an inward edge 578. Pivotally attached to component 574 at edge 578 is a bed bottom surface slide component 580, such pivotal connection being at hinges, certain of which are identified at 582. In similar fashion at panel 522, panel 520 is shown as it is angled inwardly to an extent that the inward edge of component 580 extends just beneath auger 552. Finally, FIG. 17 reveals two structurally supportive tension rods 584 and 586 coupled between forward panel assembly 526 and rear panel assembly 496. Contractor drive mechanism 514 functions to cause the elongate shafts 516 and 518 to rotate respective contractor panels 520 and 522 from a retracted location wherein the upper components 560, 574 are in immediate adjacency with the inner surface of the sides of the dump bed 26. Looking to FIG. 18, this retracted orientation is revealed. In the figure, initially it may be noted that a downwardly opening channel 590 having a triangularly shaped top 592 is connected to and extends between forward panel assembly 526 and rearward panel assembly 496. In general, it is immediately adjacent and typically rests upon the upper surface of the dump bed 26 shown in dashed line fashion in the figure at 27. When in a retracted position, note that upper component 560 of contractor panel 522 is adjacent the inner surface 36 of one side of the dump bed 26. The flared tips 594 and 596 slide just slightly above the bed bottom upper surface 27 by virtue of a small flange 598 extending inwardly from forward panel assembly 526. It may be observed that it is substantially coextensive with that inner surface. Bed bottom surface slide component 566 is seen to extend along bed bottom surface 27 and is slightly flared upwardly at 594 to promote a slidable movement. In similar fashion, the upper component 574 of contractor panel 520 is located in adjacency with the inner surface 34 of an opposite side of dump bed 26. Additionally, it may be seen that it is substantially coextensive with that inner surface. Lower component 580 extends to an upwardly flared tip 596 which slides about the upper surface of the bottom of bed 26. In the arrangement of FIG. 18, the dump bed 26 is filled with salt, and the retracted orientation of contractor panels 520 and 522 permits a use of the bed 26 to its full capacity as the salt in the bed is transported by augers 552 and 554 into the distribution system and the amount of salt carried by bed 26 decreases, a bias asserted upon the contractor panels 520 and 522 from respective shafts 516 and 518 causes them to move the remaining salt inwardly toward the augers to an extent that ultimately a V-box configuration is dynamically developed. Looking to FIG. 19, this ultimate positioning of the contractor panels 520 and 522 is represented. This is the extended orientation also represented in FIG. 17. It may be observed that, during the contractive maneuvering of salt granules toward the augers 552 and 554, a mechanical dynamic influence is exerted upon the salt to enhance the transfer of the material into the augers.

Returning to FIG. 16, the contractor drive mechanism 514 which applies the bias to shafts 516 and 518 is illustrated. Bias is asserted from a hydraulic cylinder represented generally at 600, the cylinder component of which is pivotally coupled with a cross beam 602 of the rear panel assembly 496. The piston rod 604 of cylinder 600 is shown in extended orientation connected with a cank arm 606 which, in turn, is fixed to elongate shaft 516. An auxiliary crank 608 is fixed to and extends upwardly from shaft 516 for pivotal connection with a stress transfer bar 610. Bar 610, in turn, is pivotally connected to a crank arm 612, in turn, fixed to elongate shaft 518. In the orientation shown, contractor panels 520 and 522 are in the retracted orientation of FIG. 18. As piston rod 604 is biased for retraction into hydraulic cylinder 600, a corresponding bias is asserted from cranks 606 and 612 onto respective shafts 516 and 518 to urge their associated contractor panel toward the orientation of FIG. 19.

Figure 19:
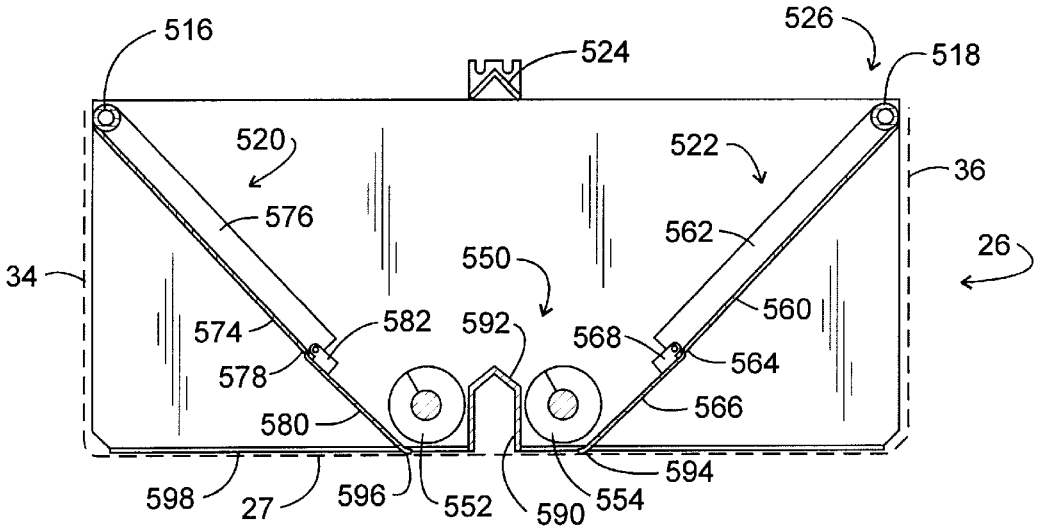
FIG. 19 is a sectional view as shown in FIG. 18 but illustrating an extended orientation of compactor panels.

Looking to FIGS. 16 and 17, the apparatus 490 may be positioned upon a dump bed 26 by an overhead crane or the like, as in the case of the earlier embodiment by the engagement with four U-shaped lugs. These lugs are seen at 620 and 621 in connection with rear panel assembly 496 in FIG. 16 and additionally at 622 and 623 in FIG. 17. Alternately, the apparatus 490 may be loaded upon the bed 26 in a manner similar to that described in connection with FIGS. 11 and 12. Looking to FIG. 20, the apparatus 490 is seen positioned upon pavement 626 in its stand-by orientation awaiting positioning on a dump bed as at 26. In contrast to the earlier embodiment, the apparatus 490 is positioned in this stand-by state using a tripod form of support. Two components of that support are from extended foot components 502 and 504. The third element of the tripod is a singular leg 628 which engages pavement 626 and is pivotally connected for dropping under the influence of gravity from open channel 590 (FIGS. 18 and 19). To retain it in its downward orientation, as before, a latching bar 630 is pivotally coupled to it and to a latching mechanism (not shown) adjacent channel 590. The forward end of channel 590 terminates in roller 632. Thus, movement of the apparatus 490 upon truck bed 26 is in the manner earlier described in connection with the initial embodiment.

Figure 21:
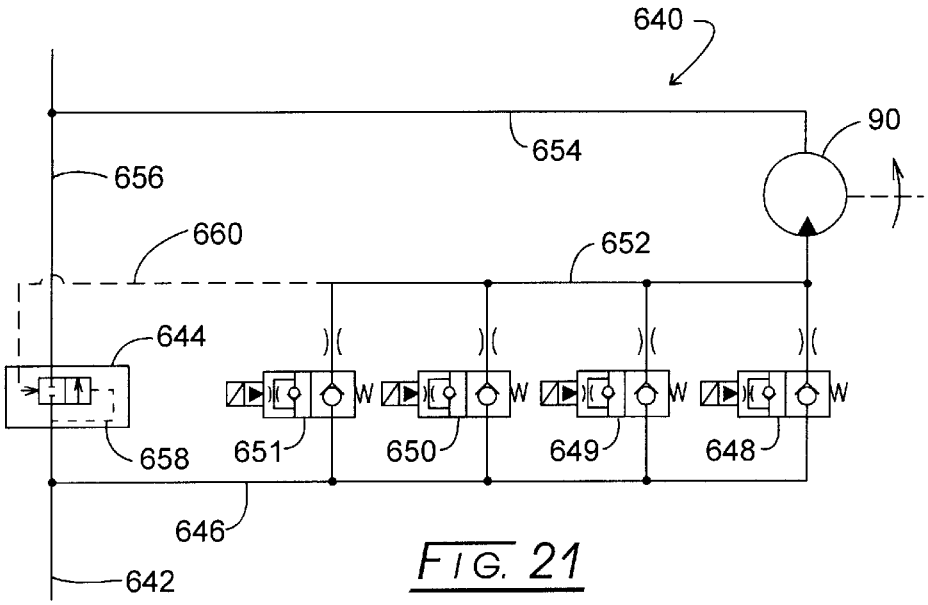
FIG. 21 is a schematic hydraulic circuit diagram showing that portion of the hydraulic system of the truck of FIG. 1 employed for driving hydrauliic motors in accordance with the invention.

As described in detail in the noted U.S. Pat. No. Re.33,835, the hydraulic circuit employed in conjunction with vehicle 10 is in series such that the flow from a pump function first satisfies the requirement of the hydraulic motor and actuators of apparatus 490. The entire flow from the pump function may be made available to motors 90 and 92 and then, may be made available for the remainder of the functions including those of the truck 10, i.e. the plow 18 and bed hoist function. Pressures for each such function are additive and the peak pressure for the series circuit is higher than for corresponding parallel circuit. Typical pressure for the augers is 300–500 psi and the pressure for motors 90 and 92 usually is under 2000 psi. With the series arrangement, no horesepower is wasted with respect to the primary engine of vehicle 10 in providing pump capacity for the bed and plow when they are not in use. This represents an advantage, for example, with parallel systems. Looking to FIG. 21, the component of this series hydraulic system employed for driving hydraulic motors as at 90 and 92 is schematically portrayed in general as hydraulic network 640. Network 640 is coupled to a principal or main hydraulic line 642. Line 642 is seen to extend both to a hydraulically actuated by-pass valve 644 and to a line 646 extending to one side of a grouping of four, speed-controlling solenoid valves 648–651. The opposite sides of valves 648–651 extend to line 652 which, in turn, extends to line 654 containing a motor such as that described at 90 and represented in the figure in symbolic fashion. Line 654 is seen to return to line 656 on the opposite side of by-pass valve 644. The activity of valve grouping 648–651 is monitored by pilot lines as represented at 658 and 660 to effect appropriate by-pass pressure compensation of valve 644. To provide for binary speed control, valves 648–651 may each be assigned one value in a sequence of binary numbers, for example, $2^0$–$2^3$. Three such binary valve arrays as at 640 are employed for controlling the brine pump hydraulic motor, the "zero velocity" motors 90 and 92, and the auger for driving the bed augers and cross auger.

Figure 22:
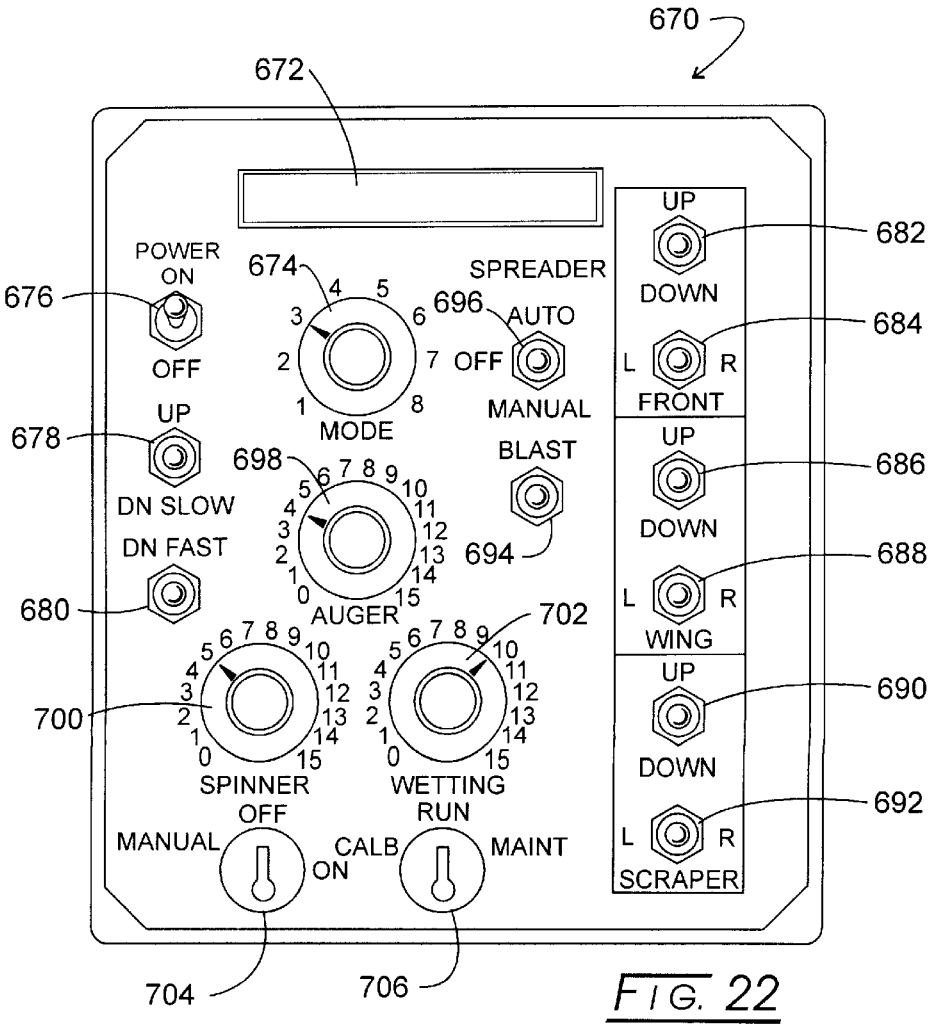
FIG. 22 is a front view of the panel of a control box or console located within the cab of the vehicle incorporating the instant invention.

The hydraulic systems employed with vehicle 10 as well as the apparatus according to the invention associated therewith is provided by a microprocessor-driven circuit. Supporting electronic components for control over the system are retained within the cab 12 of the vehicle 10 and, preferably, within a tamper-proof and environmentally secure console or control box which is mounted at a location for convenient access by the operator. The user interfacing front of such control box is illustrated in connection with FIG. 22. Referring to FIG. 22, the face of a control box or console is represented in general at 670. Positioned at this forward face is an LCD display 672 providing for readouts to the operator depending upon the positioning of a mode switch 674. Switch 674 is movable to any of eight positions from 1 to 8 providing, respectively: the speed of vehicle 10 in miles per hour, the deposition of material rates in pounds per mile; day and time; distance measured in feet from a stop position; distance measured from a stop position in miles; a data logging option; temperature of hydraulic fluid; and pressure of hydraulic fluid. Main power is controlled from switch 676 and movement of the bed 26 up and down normally or slowly is controlled from switch 678. Correspondingly, a fast down movement of bed 26 can be controlled from switch 680. Control over the main plow or front plow 18 in terms of elevation is provided at switch 682, while left-right or plow angle control is provided from switch 684. Correspondingly, control over a wing plow in terms of elevation is provided from switch 686 and right-left directional control is provided from switch 688. Elevational control of a scraper plow is provided from switch 690, while a corresponding left-right orientation of the scraper plow is controlled from switch 692. Auger blast actuation is developed at switch 694, and the selection of either a fully automatic salt dispensing function or a manual salt dispensing function is elected by actuation of toggle switch 696. Additionally, the switch 696 has an orientation for turning off the spreader or distribution function. When this switch is in an automatic orientation, the amount of snow-ice material is controlled automatically with respect to the speed of vehicle 10 and predetermined inserted data as to, for example, poundage per mile. When in a manual operational mode, the rate of material output is set by the operator. In electing these amounts, for example, an auger switch 698 may be positioned at any of 16 detent orientations for selecting the quantity of material deposited. When the system is in automatic mode as elected at switch 696, this switch 698 selects the rate of material application in pounds per mile, adjusting the hydraulic control system automatically with respect to vehicle speed. The control of the speed of an impeller, for the instant application, the impeller motors 90 and 92, is derived manually by the 16 position switch 700. When switch 696 is in an automatic mode and the impeller switch 700 is in its 16th position, the speed of motors 90 and 92 are automatically elected with respect to vehicle speed. Thus, to invoke the operation of the instant invention, switch 700 is set to its last position or number 15 and switch 696 is set for an automatic mode of spreader control. Control over the motor driving the brine pump is provided from switch 702. Two additional switches are provided at the console face plate 670, and these switches are key-actuated for security purposes. The first such switch as at 704 provides a manual lock-out function wherein the operator is unable to operate the system on a manual basis and must operate it on an automatic basis. Correspondingly, switch 706 moves the control system into a calibrate/maintenance mode.

Figure 23:
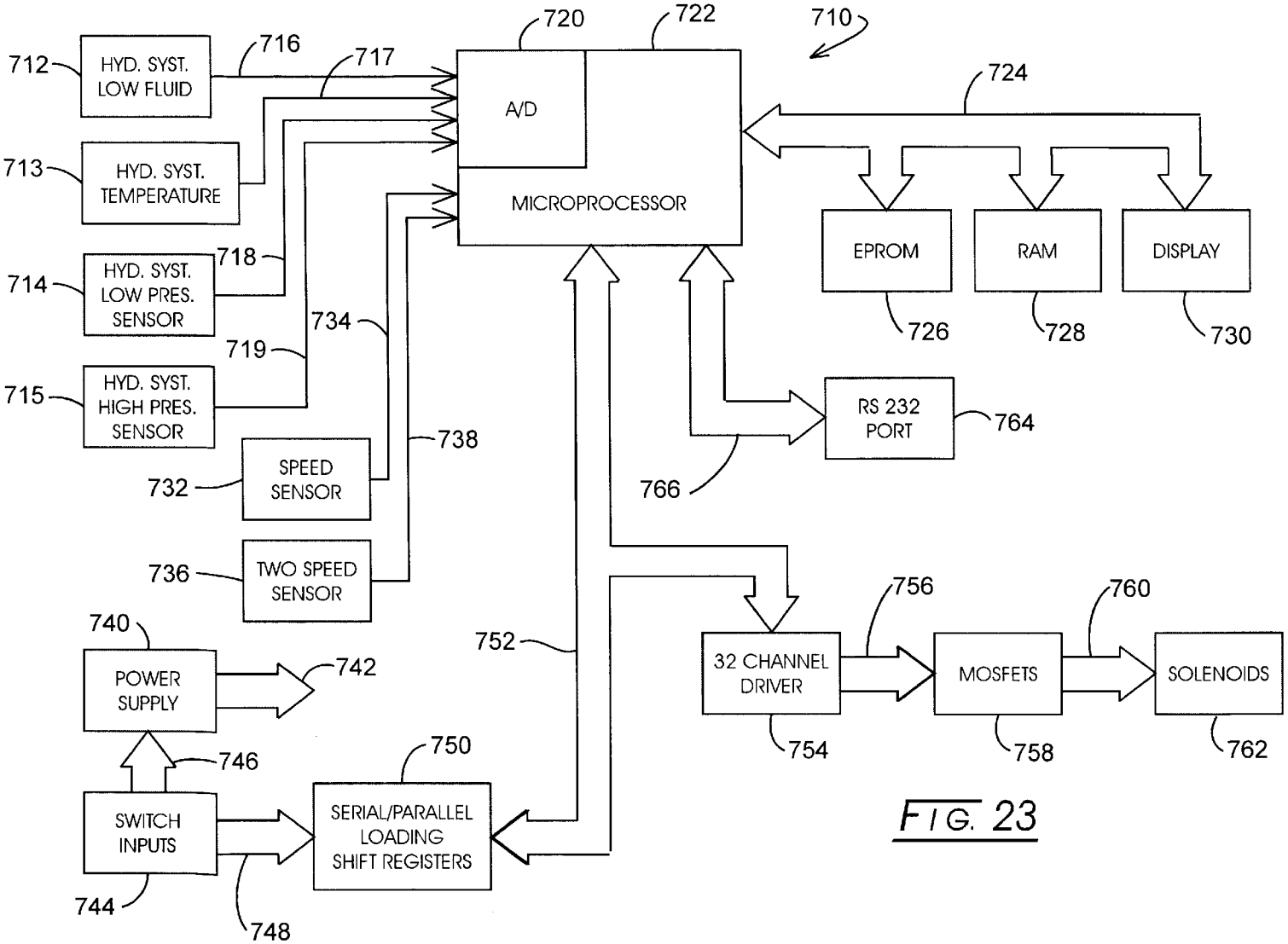
FIG. 23 is a block schematic diagram of a control circuit which may be employed with the invention.

Referring to FIG. 23, a block diagrammatic representation of a microprocessor driven control function for vehicle 10 and its associated apparatus 40 or 490 is identified generally at 710. The control function operates in conjunction with six sensor functions. In this regard, a hydraulic system low fluid sensor is provided as represented at block 712. A hydraulic system temperature sensor function is provided as represented at blocks 713. A hydraulic system low pressure sensor function is provided as represented at block 714, and a hydraulic system high pressure sensor is provided as represented at block 715. The functions represented at blocks 712–715 provide analog inputs as represented at respective lines 716–719 to the analog-to-digital function represented at sub-block 720 of a microprocessor represented by block 722. Microprocessor 722 may be provided as a type 68HC11 marketed by Motorola Corporation. Device 722 is a high-density complementary metal-oxide semi-conductor with an 8-bit MCU with on chip peripheral capabilities. These peripheral functions include an eight-channel analog-to-digital (A/D) converter with 8 bits of resolution. An asynchronous serial communications interface (SCI) is provided, and a separate synchronous serial peripheral interface (SPI) are included. The main 16-bit, free-running timer system has three input capture lines, five output-compare lines, and a real time interrupt function. An 8-bit pulse accumulator sub-system can count external events or measure external periods. Device 722 performs in conjunction with memory (EPROM) as represented at bidirectional bus 724 and block 726. Communication also is seen to be provided via bus 724 with random access memory (RAM) which may be provided, for example, as a DS 1644 non-volatile time-keeping RAM marketed by Dallas Semi-Conductor Corporation and represented at block 728. The LCD display 672 is represented at block 730. This function may be provided by a type DV-16100 S1FBLY assembly which consists of an LCD display, a CMOS driver and a CMOS LSI to controller marketed by Display International of Oviedo, Fla. Digital sensor input to the microprocessor function 722 are provided from a speed sensor represented at block 732 and line 734, as well as a two-speed sensor function represented at block 736 and line 738.

The circuit power supply is represented at block 740. This power supply, providing two levels of power, distributes such levels where required as represented at arrow 742. The supply 740 is activated from the switch inputs as discussed in conjunction with FIG. 22 and represented in the instant figure at block 744, communication with the power supply being represented by arrow 746. These switch inputs as represented at block 744 also are directed as represented at bus 748 to serial/parallel loading shift registers as represented at block 750. As represented by bus 752, communication with the function at block 750 is provided with the microprocessor function represented at block 722. Bus 752 also is seen directed to a 32 channel driver function represented at block 754. Function 754 may be implemented with a 32-channel serial-to-parallel converter with high voltage push-pull outputs marketed as a type HB9308 marketed by Supertex, Inc. The output of the driver function represented at block 754 is directed as represented by arrow 756 to an array of metal oxide semi-conductor field effect transistors (MOSFETS) as represented at block 758. These devices may be provided as auto protected MOSFETS type VNP10N07F1 marketed by SGS-Thomson Microelectronics, Inc. The outputs from the MOSFET array represented at block 758 are directed as represented by arrow 760 to solenoid actuators as represented at block 762. An RS232 port is provided with the control function 710 as represented at block 764 and arrow 766 communicating with microprocessor function 722.

Figure 24:
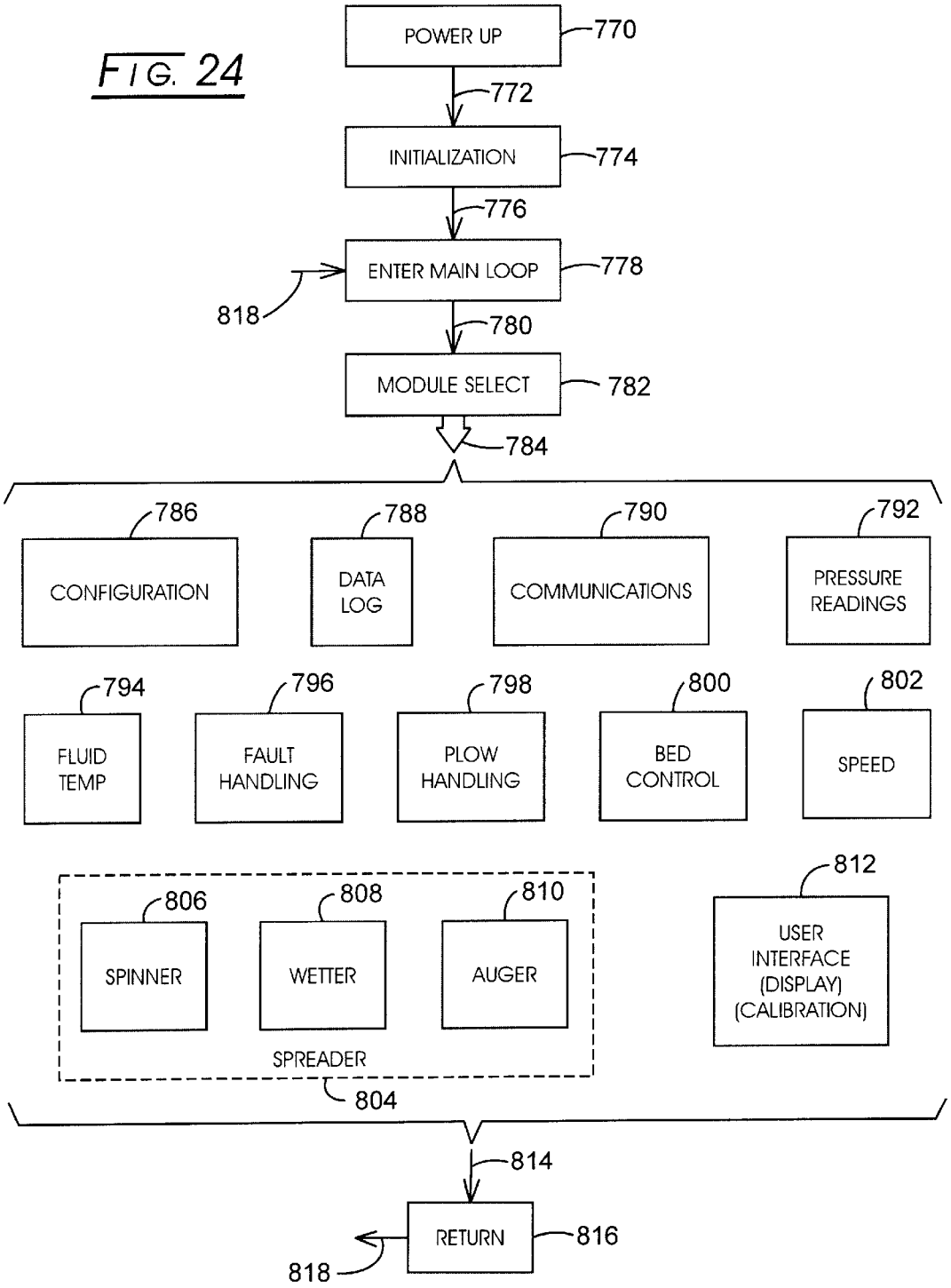
FIG. 24 is a block diagram illustrating the general control program employed with the invention.

Referring to FIG. 24, a block diagram of the program with which the microprocessor function represented at block 722 performs is set forth. As represented at block 770, the program carries out a conventional power up procedure upon the system being turned on. Then as represented by line 772 and block 774, conventional initialization procedures are carried out. Upon completion of the initialization procedures, as represented by line 776 and block 778, the program enters into a main loop. In effect, the main loop performs in the sense of a commutator, calling a sequence of tasks or modules. Certain of those tasks are idle tasks which are activated when no other components of the program are active. Additionally, the system is somewhat event driven to the extent that it monitors random inputs as from switches and the like. Thus, as represented at line 780 and block 782, the main loop functions to select modules in a sequence and the module identification and selection is represented by arrow 784. An initial module is represented at block 786 which provides a configuration function, particularly with respect to the entering of new data into memory when configurations change. Block 788 represents a data log module wherein data for a given trip of the vehicle is recorded. For example, data is collected each five seconds with respect to such functions as turning on the augers, auger speeds, and the like. Such information then may be read out as a record at the end of any given trip or the like. A module providing for communications as represented at block 790 handles the function of the RS232 port. Block 792 represents a pressure readings module which carries out a sampling of hydraulic pressure at a relatively fast rate and provides a filtering in software to improve values from that. The fluid temperature module represented at block 794 periodically reads hydraulic fluid temperature and carries out software filtering of the data. Block 796 represents a fault handling module which looks for various fault conditions in the system and provides a two second fault message at the LCD display. This module also can carry out shut down procedures under certain conditions. Block 798 describes a plow handling module which functions to carry out control of the front, wing, and scraper plows which may be employed with truck 10. A bed control module is represented at block 800 which handles the control of dump bed 26. Block 802 looks to a module which develops distance and speed data. Block 804 represents a composite module identified as a spreader module. In this regard, the module tracks data concerning the spinner, i.e. ejector function performance represented at block 806. Additionally, the spreader module looks to the performance of the brine delivery pumping function as represented at block 808 and, finally, the spreader module considers the speed of the augers as driven from an auger motor. It may be recalled that this motor drives the bed auger, and the cross auger is slaved to it. Block 812 represents a user interface module which responds to a variety of user interface activities such as switching. It includes a submodule for providing display outputs and for responding to calibration inputs.

When the modules have been evaluated in the main loop, then as represented at line 814 and block 816, the program returns and as represented at line 818 which reappears in conjunction with block 778, the main loop again is entered.

Since certain changes may be made to the above-described method and apparatus without departing from the scope of the invention herein involved, it is intended that all matter contained in the description thereof and shown in the accompanying drawings shall be interpreted as illustrative and not in a limiting sense.

I claim:

1. In a vehicle having a wheel mounted frame supporting an engine and a bed having an upwardly disposed bed surface oppositely disposed first and second sides and extending longitudinally from a forward region to a rearward region, said vehicle being movable over a plane defining pavement at a given forward velocity and forward direction, the improved apparatus for depositing granular snow-ice treatment material upon said pavement, comprising:

a bed transport mechanism positioned upon said bed and extending longitudinally substantially from said forward region to said rearward region and engageable with said material to convey it to an outlet at said rearward region;

a material feed structure having oppositely disposed surfaces supported upon said bed, each having an orientation extending angularly downwardly toward said bed transport mechanism to define a hopper and being substantially coextensive with said bed transport mechanism;

a cross structure supported adjacent said bed rearward region and oriented transversely with respect to said bed transport mechanism;

a first ejector mechanism supported upon said cross structure having an input, including a first impeller rotatable about an impeller axis and extending to an outer periphery, a lower disposed receiving surface, a first sidewall component extending about said first impeller outer periphery and defining a first output opening of predetermined widthwise extent through which said material may be expressed, a first drive assembly coupled in driving relationship with said first impeller and driving it at a rotational rate effective to move said material from said first input to said outer periphery and for ejecting said material from said first output opening along a principal direction and at a principal velocity having a velocity and direction vector component corresponding with said vehicle forward velocity and in a direction substantially opposite to said vehicle forward direction and said principal direction, principal velocity and widthwise extent being selected to deposit said material upon said pavement as a narrow band;

a second ejector mechanism supported upon said cross structure in spaced apart relationship with said first ejector mechanism, having an input, including a second impeller rotatable about an impeller axis and extending to an outer periphery, a lower disposed receiving surface, a second sidewall component extending about said second impeller periphery and defining a second output opening of predetermined widthwise extent through which said material may be expressed, a second drive assembly coupled in driving relationship with said second impeller and driving it at a rotational rate effective to move said material from said second input to said outer periphery and for ejecting said material from said second output opening along a said principal direction and principal velocity and said principal direction, principal velocity and widthwise extent being selected to deposit said material upon said pavement as a narrow band;

a cross transport mechanism supported at said cross structure, having an input receiving said material from said bed transport mechanism outlet and oppositely disposed first and second feed outlets connected with respective said first aid second ejector mechanism inputs.

2. The apparatus of claim 1 in which said first and second ejector mechanisms are configured to eject said material along a said principal direction oriented downwardly at an acute angle with respect to said plane.

3. The apparatus of claim 2 in which said acute angle is less than about 15 degrees.

4. The apparatus of claim 1 including:

a forward panel assembly removably locatable upon said bed surface at said forward region;

a rearward panel assembly removably locatable upon said bed at said rearward region;

said bed transport mechanism being supportably connected between said forward panel assembly and said rearward panel assembly;

said cross structure is supported by said rearward panel assembly;

said material feed structure is supportably connected between said forward panel assembly and said rearward panel assembly; and said first and second ejector mechanisms are supported from said rearward panel assembly.

5. The apparatus of claim 4 in which said material feed structure comprises:

a first contractor panel assembly pivotally mounted to and extending between said forward panel assembly and said rearward panel assembly adjacent said bed first side;

a second contractor panel assembly pivotally mounted to and extending between said forward panel assembly and said rearward panel assembly adjacent said bed second side; and a contractor panel drive assembly for driving said first and second contractor panel assemblies to pivotally move toward said bed transport mechanism against said treatment material.

6. The apparatus of claim 5 in which:

said first contractor panel assembly includes a first drive shaft rotatably mounted between said forward panel assembly and said rearward panel assembly adjacent said bed first side, an elongate first upper panel component having an upper side fixed in driven relationship to said first drive shaft and having an oppositely disposed lower side, and an elongate first slide component having one side substantially coextensive with and pivotally mounted to said first upper panel component lower side and having an opposite side slideably movable in adjacency with said bed surface to a location adjacent said bed transport mechanism;

said second contractor panel assembly includes a second drive shaft rotatably mounted between said forward panel assembly and said rearward panel adjacent said bed second side, an elongate second panel component having an upper side fixed in driven relationship to said second drive shaft end having an oppositely disposed lower side, and an elongate second slide component having one side substantially coextensive with and pivotally mounted to said second upper panel component lower side and having an opposite side slidably movable in adjacency with said bed surface to a location adjacent said bed transport mechanism; and said contractor panel drive is coupled in drive relationship with said first and second drive shafts.

7. The apparatus of claim 5 in which:

said contractor panel drive is actuable to bias said first upper panel component to move from a retracted orientation in parallel adjacency with said bed first side to an extended orientation extending angularly outwardly from said bed first side, and to bias said second upper panel component to move from a retracted orientation in parallel adjacency with said bed second side to an extended orientation extending angularly outwardly from said bed second side.

8. The apparatus of claim 7 in which:

said first upper panel component lower side extends into close adjacency with said bed surface when said first upper panel component is in said retracted orientation; and said second upper panel component lower side extends into close adjacency with said bed surface when said second upper panel component is in said retracted orientation.

9. The apparatus of claim 4 including:

a material delivery chute supported at said rear panel assembly, and having an input in material receiving relationship with said bed transport mechanism, having an output in material feed relationship with said cross transport mechanism input; and a distribution vane mounted within said delivery chute having a neutral orientation for distributing said material equally to said cross transport mechanism first and second feed outlets, and actuable into first and second exclusive feed orientations for diverting all said material within said delivery chute respectively to said first and second cross transport mechanism first and second feed outlets.

10. The apparatus of claim 4 in which:

said bed transport mechanism comprises first and second, parallel augers rotatably supported upon bearings, said bearings being mounted upon said forward panel assembly and said rearward panel assembly in isolation from said material.

11. The apparatus of claim 1 in which said cross transport mechanism comprises a first auger component rotatable to transfer said material from said input to said first feed outlet, and a second auger component rotatable to transfer said material from said input to said second feed outlet.

12. The apparatus of claim 1 including a deflector positioned in adjacency with said first ejector first output opening and actuable to move into confrontation with said material ejected therefrom to effect a widened broadcasting of said material over said pavement.

13. The apparatus of claim 1 including:

a brine formation tank positioned upon said bed surface having an upwardly disposed opening and a lower disposed flow outlet;

a brine holding tank positioned upon said bed surface having a lower disposed holding tank inlet and a holding tank outlet;

a liquid transfer conduit coupled between said flow outlet and said holding tank inlet; and a pump driven liquid transfer assembly coupled with said brine holding tank and actuable to transfer liquid therefrom to said cross transport mechanism for mixing with said material.

14. The apparatus of claim 13 in which:

said brine formation tank includes a plurality of baffles having liquid transfer and filtering openings therein and defining a normally fully enclosed final filtering stage in fluid flow communication with said lower disposed flow outlet.

15. The apparatus of claim 13 in which:

said brine formation tank includes a cover pivotally mounted thereon for movement to a closed orientation over said upwardly disposed opening, said cover forming a component of said material feed structure when in said closed orientation.

16. The apparatus of claim 13 in which said brine holding tank is configured having a surface forming a component of said material feed structure.

17. Apparatus for dispensing granular snow/ice treatment material through an opening upon pavement from a vehicle moving thereon at a given speed, comprising:

a support assembly connectable with said vehicle;

an impeller mounted upon said support assembly for rotation about an impeller axis, having a lower disposed receiving surface extending from said impeller axis to define an impeller circular periphery and a upwardly disposed input portion for receiving said material;

a feed duct positioned at said impeller input portion and having a feed outlet for directing said material into said impeller;

a plurality of freely rotating pulleys located in spaced adjacency with said impeller circular periphery, each having a stainless steel cylindrical belt engaging surface defining an inner cavity, top and bottom components enclosing said cavity, a shaft mounted upon said support structure and extending through said top component and into said cavity, a first bearing within said cavity rotationally coupling said top component with said shaft, a second bearing within said cavity rotationally coupling said bottom component with said shaft, a seal extending about said shaft within said top component above said first bearing, and a cover mounted upon said shaft upwardly from and extending over said top component;

an upstanding endless belt assembly mounted upon said pulleys at the belt engaging surfaces thereof for movement with and formation of a side of said impeller at select portions of said circular periphery and having spaced apart loop portions formed with two of said pulleys defining said opening through which said material received from said feed duct may be expressed at a principal outlet velocity and principal direction;

a motor mounted with said support assembly for effecting the rotation of said impeller about said impeller axis; and a control responsive to said vehicle speed for actuating said motor to effect rotation of said impeller at a rate expressing said material at a said principal outlet velocity commensurate with said vehicle given speed.

18. The apparatus of claim 17 in which said pully top and bottom components are formed of mild steel.

19. The apparatus of claim 17 in which said impeller and said plurality of pulleys are mounted upon said support assembly at an acute angle downwardly directed with respect to said pavement.

20. The apparatus of claim 19 in which said acute angle is less than about 15 degrees.

21. The apparatus of claim 17 including a deflector positioned in adjacency with said ejector output opening nad actuable to move into confrontation with said material ejected therefrom to divert said ejected material laterally of said vehicle.

22. In a vehicle having a wheel mounted frame supporting an engine and a bed extending longitudinally from a forward region to a rearward region, said vehicle being movable over a plane defining pavement at a given forward velocity and forward direction, the improved apparatus for depositing granular snow-ice treatment material upon said pavement, comprising:

a bed transport assembly positioned upon said bed and extending substantially from said forward region to said rearward region and engageable with said material to convey it to an outlet at said rearward region;

a support structure mounted upon said vehicle at said rearward region;

an ejector mechanism having an input for receiving said material conveyed by said bed transport assembly to said outlet, including an impeller rotatable about an impeller axis and extending to an outer periphery, a lower disposed receiving surface, a sidewall component extending about said impeller outer periphery and defining an output opening of predetermined widthwise extent through which said material may be expressed, a drive assembly coupled in driving relationship with said impeller and driving it at a rotational rate effective to move said material from said input to said outer periphery and for ejecting said material from said output opening at a principal velocity corresponding with said vehicle forward velocity and along a principal direction substantially opposite to said vehicle forward direction and downwardly toward said pavement at an acute angle with respect to said plane, said principal velocity, said principal direction, said widthwise extent and said acute angle being selected to deposit said material upon said pavement as a narrow continuous band.

23. The apparatus of claim 22 in which said acute angle is less than about 15 degrees.

24. The apparatus of claim 22 which said acute angle is in a range of about 7 to 10 degrees.

25. The apparatus of claim 22 which said output opening widthwise exent is effective to deposit said material upon said pavement as a narrow continuous band having a width of about one foot.

26. The apparatus of claim 22 including a deflector positioned in adjacency with said ejector output opening and actuable to move into confrontation with said material ejected therefrom to divert said ejected material laterally of said vehicle.

* * * * *